US006682239B2

(12) United States Patent
Mori et al.

(10) Patent No.: US 6,682,239 B2
(45) Date of Patent: Jan. 27, 2004

(54) THERMAL PRINTER UNIT AND THERMAL PRINTER

(75) Inventors: Yukihiro Mori, Shinagawa (JP); Hiromi Ohtsuka, Shinagawa (JP)

(73) Assignee: Fujitsu Takamisawa Component Limited, Tokyo (JP)

( * ) Notice: Subject to any disclaimer, the term of this patent is extended or adjusted under 35 U.S.C. 154(b) by 72 days.

(21) Appl. No.: 09/881,739

(22) Filed: Jun. 18, 2001

(65) Prior Publication Data

US 2002/0021927 A1 Feb. 21, 2002

(30) Foreign Application Priority Data

Aug. 8, 2000 (JP) ..... 2000-240477
Oct. 5, 2000 (JP) ..... 2000-306725

(51) Int. Cl.[7] ..... B41J 11/04; B41J 11/16
(52) U.S. Cl. ..... 400/649; 400/120.16; 347/220
(58) Field of Search ..... 400/649, 650, 400/691, 693, 120.16, 120.17; 347/220

(56) References Cited

U.S. PATENT DOCUMENTS

| | | | | |
|---|---|---|---|---|
| 4,778,296 A | | 10/1988 | Takahashi | 400/708 |
| 5,579,043 A | * | 11/1996 | Patry | 347/222 |
| 6,004,053 A | | 12/1999 | Petteruti | 400/693 |

FOREIGN PATENT DOCUMENTS

| | | | | |
|---|---|---|---|---|
| EP | 572700 A1 | * | 12/1993 | B41J/13/22 |
| JP | 59-16458 | | 1/1984 | |
| JP | 1-222980 | | 9/1989 | |
| JP | 2-160558 | | 6/1990 | |
| JP | 4-249184 | | 9/1992 | |
| JP | 05212923 A | * | 8/1993 | B41J/11/20 |
| JP | 5-238597 | | 9/1993 | |
| JP | 9-323454 | | 12/1997 | |
| JP | 10-258532 | | 9/1998 | |
| JP | 2000-85168 | | 3/2000 | |
| JP | 2000272201 A | * | 10/2000 | B41J/29/13 |

* cited by examiner

*Primary Examiner*—Daniel J. Colilla
(74) *Attorney, Agent, or Firm*—Staas & Halsey LLP

(57) ABSTRACT

A thermal printer unit includes a thermal head assembly and a platen roller. The thermal head assembly includes a frame having platen roller receiving parts receiving both ends of the platen roller, respectively; a thermal head mounted on the frame; and a spring member mounted on the frame and applying a head pressure to the thermal head. Each platen roller receiving part comprises: a vertical groove part having an opening at the top thereof; a horizontal groove part extending from the bottom of the vertical groove part in a direction such as to be away from the thermal head; and a projection part formed relatively by the vertical groove part and horizontal groove part, located above the horizontal groove part, and projecting from a recess part of the horizontal groove part toward the thermal head. Both ends of the platen roller are inserted into the horizontal groove parts, respectively, and, also, are pressed by the spring member via the thermal head into the recess parts thereof, respectively.

12 Claims, 24 Drawing Sheets

FIG.19

| CONDITION | OUTPUT OF COMPARATOR 171-1 | OUTPUT OF COMPARATOR 171-2 |
|---|---|---|
| ① NORMAL | H | H |
| ② PLATEN RELEASE | L | L |
| ③ PAPER NEAR END | H | L |
| ④ PAPER END | L | H |

THERMAL PRINTER UNIT AND THERMAL PRINTER

BACKGROUND OF THE INVENTION

1. Field of the Invention

The present invention relates to a thermal printer unit and a thermal printer, and, in particular, to a thermal printer unit and a thermal printer applied to a portable terminal apparatus and a POS (Point Of Service) apparatus, and employing rolled paper.

For a printer of a portable terminal apparatus or a POS apparatus, increase in printing speed and easy exchange of printing paper are demanded. In order to deal with these requests, a line thermal printer employing rolled paper as printing paper is used.

2. Description of the Related Art

FIG. 1 shows a line thermal printer 10 in the related art. FIG. 2 shows a general configuration of the line thermal printer 10 shown in FIG. 1. FIGS. 3A, 3B and 3C illustrate operation of a platen roller and a thermal head of the line thermal printer 10 shown in FIG. 1.

The line thermal printer 10 is of a clam-shell-type, and has a body 11 and a cover 13 supported by a shaft 12 on the body 11. The body 11 has a paper roll containing part 11*a* in which a paper roll is contained, and, also, has the thermal head 15 incorporated therein together with a head pressing spring 14. The platen roller 16 is supported on an extending end of the cover 13. In the body 11, grooves 18 in which a shaft 17 of the platen roller 16 is fitted are formed. Each of these grooves 18 has a shape of a vertically extended straight line and has an opening 18*a* at the top thereof, as shown in FIG. 3A.

The line thermal printer 10 enters a condition, shown in FIGS. 2 and 3C, such that the printer 10 can perform printing as a result of: the cover 13 being opened; the paper roll 20 having a paper end 21 thereof unwound partially being contained in the paper roll containing part 11*a*; the unwound paper end 21 being drawn out so as to pass in front of the thermal head 15; and the cover 13 being closed. That is, at the last stage of closing the cover 13, the platen roller 16 comes into contact with the thermal head 15 and pushes it out, the shaft 17 enters the grooves 18, and, the platen roller 16 reaches a position shown in FIGS. 2 and 3C, as shown in FIGS. 3A and 3B. In this condition, the head pressing spring 14 presses the thermal head 15 onto the platen roller 16 by a force F1 (functioning as a head pressure), and the paper end 21 is sandwiched between the thermal head 15 and platen roller 16, as shown in FIG. 2. Further, the platen roller 16 and cover 13 are locked together in a condition in which the shaft 17 of the platen roller 16 is fitted into the grooves 18 and are pressed onto the bottoms of the grooves 18 by the above-mentioned force F1.

As the necessity arises, the paper roll 20 is exchanged after the cover 13 is opened as a result of the end of the cover on the side of the platen roller 16 being pulled up with a strong force.

In this line thermal printer 10, when the cover 13 is opened, a wide space is formed between the thermal head 15 and platen roller 16, and, thereby, exchange of the paper roll 20 can be easily performed. Further, the cover 13 is locked through the operation of closing the cover 13, and the lock is released as a result of the cover 13 being pulled up. Accordingly, any other special locking operation or lock releasing operation is needed to be performed. Accordingly, the printer 10 is convenient in operation thereof.

There is a possibility that a portable terminal apparatus is knocked or dropped by accident during handling thereof. Accordingly, the line thermal printer which is incorporated in the portable terminal apparatus is required to have a strong locking mechanism such that the cover 13 is prevented from being opened by accident, even when the portable terminal apparatus is knocked or dropped.

As shown in FIG. 3C, in the above-mentioned line thermal printer 10, the cover 13 is locked or prevented from opening by the force F1. Accordingly, in order to achieve the stronger locking mechanism as mentioned above, it is necessary to increase the force F1 applied by means of the head pressing spring 14.

However, when the force F1 is increased, the head pressure may become larger than a proper head pressure. Thereby, the printing quality may be degraded, the thermal head 15 may be easily worn so as to have a shorter life, and so forth.

In contrast to this, when it is demanded that the locking of the cover be easily released, the above-mentioned force F1 applied by the head pressing spring 14 is to be decreased. However, when the force F1 is decreased, the head pressure may become lower than the proper one, and, as a result, the print becomes faint.

Further, the thermal head 15 is inclined in the direction of the grooves 18 as shown in FIG. 2 so that the force F1 is directed obliquely downward. Thereby, at the last stage of closing the cover 13, the platen roller 16 may come into contact with a top corner 15*a* of the thermal head 15 strongly, as shown in FIG. 3A. Thereby, the platen roller 16 may be harmed.

FIG. 11 shows a line thermal printer unit 130 incorporated in another clam-shell-type line thermal printer in the related art. In the line thermal printer unit 130, a thermal head assembly 132 is incorporated into a frame 131, and, also, a platen roller assembly 133 is incorporated into the frame 131 detachably.

On the bottom of the frame 131, a photosensor 134 for detecting roll paper is mounted, and, also, a mechanical switch 135 for detecting that the platen roller assembly is mounted at a proper position is mounted on a side wall of the frame 131. A detecting knob part 135*a* of the mechanical switch 135 projects into a depressed receiving part 138 of the frame 131 used for mounting the platen roller assembly 133 therein. A flexible cable 136 extends from the photosensor 134, while a normal covered cable 137 extends from the mechanical switch 137.

In this thermal printer unit 130, because the frame 131 has not an enough space therein, the mechanical switch 135 is mounted on the outer wall of the frame 131. Accordingly, the substantial lateral length of the line thermal printer unit 130 becomes larger by the mechanical switch 135 than that of the frame 131 itself.

Further, as the photosensor 134 and mechanical switch 135 are components different in type therebetween, the manufacturing costs thereof are high.

Further, works of wiring the flexible cable 136 and covered cable 137, which are different in type therebetween, are troublesome, accordingly.

SUMMARY OF THE INVENTION

An object of the present invention is to provide a thermal printer unit and a thermal printer in which the above-described problems are solved.

A thermal printer unit according to the present invention comprises:

a thermal head assembly; and a platen roller, wherein:

the thermal head assembly comprises:

a frame having platen roller receiving parts receiving both ends of the platen roller, respectively;

a thermal head mounted on the frame; and a spring member mounted on the frame and applying a head pressure to the thermal head, wherein each platen roller receiving part comprises:

a vertical groove part having an opening at the top thereof;

a horizontal groove part extending from the bottom of the vertical groove part in a direction such as to be away from the thermal head; and a projection part formed relatively by the vertical groove part and horizontal groove part, located above the horizontal groove part, and projecting from a depth part of the horizontal groove part toward the thermal head, and wherein both ends of the platen roller are inserted into the horizontal groove parts of said platen roller receiving parts, respectively, and, also, are pressed by the spring member via the thermal head into the depth parts thereof, respectively.

In this configuration, both ends of the platen roller are loaded into the depth parts of the horizontal groove parts of the platen roller receiving parts in a condition in which the ends of the platen roller being pressed toward the depth parts of the horizontal groove parts by the spring member. Thus, the platen roller is locked into the platen roller receiving parts. In this configuration, by adjusting the dimension and shape of the projection parts, it is possible to control the strength of locking of the platen roller into the platen roller receiving parts without changing the head pressure applied to the thermal head by the spring member. Accordingly, it is possible to achieve an appropriate strength of the locking of the platen roller while maintaining the printing quality.

The platen roller may comprise bearing members at both ends thereof; and the bearing members rotatably support the both ends of the platen roller in the horizontal groove parts, respectively.

Thereby, as the outer shell of the bearing members do not rotate while the platen roller rotates, a force for causing the platen roller to be removed from the platen roller receiving parts is prevented from being generated during the printing operation. Accordingly, it is possible to maintain a stable locked condition of the platen roller.

A member may be provided for covering the top end of the thermal head so as to prevent the platen roller from directly coming into contact with the top end of the thermal head.

Thereby, when the platen roller is being fitted into the platen roller receiving parts, the platen roller can be prevented from coming into contact with the top end of the thermal head directly. Accordingly, it is possible to prevent the platen roller from being harmed.

A thermal printer according to the present invention comprises:

a body comprising a paper roll containing part for holding a paper roll;

a thermal head assembly mounted on the body, and comprising: a frame having platen roller receiving parts receiving both ends of a platen roller, respectively; a thermal head mounted on the frame; and a spring member mounted on the frame and applying a head pressure to the thermal head; and a cover rotatably supported on the body, supporting the platen roller, and covering an opening of the paper roll containing part, wherein, in a condition in which the opening of the paper roll containing part is covered by the cover, the platen roller is pressed onto the thermal head, and the platen roller is fitted into the platen roller receiving parts so that the cover is maintained in the condition in which the opening is covered by the cover, and wherein each platen roller receiving part comprises:

a vertical groove part having an opening at the top thereof;

a horizontal groove part extending from the bottom of the vertical groove part in a direction such as to be away from the thermal head; and a projection part formed relatively by the vertical groove part and horizontal groove part, located above the horizontal groove part, and projecting from a depth part of the horizontal groove part toward the thermal head, and wherein, in the condition in which the cover covers the opening of the paper roll containing part, both ends of the platen roller are inserted into the horizontal groove parts of the platen roller receiving parts, respectively, and, also, are pressed by the spring member through the thermal head into the depth parts thereof, respectively.

In this configuration, both ends of the platen roller are loaded into the recess parts of the horizontal groove parts of the platen roller receiving parts in a condition in which the ends of the platen roller being pressed toward the depth parts of the horizontal groove parts by the spring member. Thus, the platen roller is locked into the platen roller receiving parts. In this configuration, by adjusting the dimension and shape of the projection parts, it is possible to control the strength of locking of the platen roller into the platen roller receiving parts without changing the head pressure applied to the thermal head by the spring member. Accordingly, it is possible to achieve an appropriate strength of the locking of the platen roller while maintaining the printing quality.

The platen roller may comprise bearing members at both ends thereof; and the bearing members rotatably support the both ends of the platen roller in the horizontal groove parts, respectively.

Thereby, as the outer shell of the bearing members do not rotate while the platen roller rotates, a force for causing the platen roller to be removed from the platen roller receiving parts is prevented from being generated during printing operation. Accordingly, it is possible to maintain a stable locked condition of the platen roller.

A member may be provided for covering the top end of the thermal head so as to prevent the platen roller from directly coming into contact with the top end of the thermal head.

Thereby, when the platen roller is being fitted into the platen roller receiving parts, the platen roller can be prevented from coming into contact with the top end of the thermal head directly. Accordingly, it is possible to prevent the platen roller from being harmed.

A position on an outline of the platen roller at which the thermal head comes into contact with the platen roller loaded into the horizontal groove parts may be different in a direction reverse to a direction in which the platen roller rotates during feeding the paper from a position on the side of the thermal head at which the outline of the platen roller is intersected by a straight line passing through both the rotational axis of the cover and the center of the platen roller loaded into the horizontal groove part.

Thereby, the angle of inclination of the thermal head with respect to a bottom surface of the frame becomes nearly 90 degrees, and a dimension the top end of the thermal head projects toward the platen roller is short, so that a hit of the platen roller by the top end of the thermal head becomes a weaker one, and, thus, the platen roller is prevented from being harmed thereby.

A thermal printer unit according to another aspect of the present invention comprises:

a thermal head assembly; and a platen roller, wherein:

the thermal head assembly comprises:

a frame having a platen roller receiving part receiving the platen roller;

a thermal head mounted on the frame; and a spring member mounted on the frame and applying a head pressure to the thermal head, wherein:

the thermal head assembly further comprises photosensors provided on the rear side of the platen roller receiving part so as to face the platen roller; and the photosensors are used for detecting, through a combination of outputs thereof, any of a condition in which printing operation of the printer unit can be properly performed, a condition in which paper for the printing is nearly run out, a condition in which the paper for the printing is run out, and a condition in which the platen roller is removed from the platen roller receiving part.

As the photosensors are disposed on the rear side of the platen roller receiving part, the lateral dimension of the thermal printer unit is prevented from increasing much although the photosensors are provided for detecting various conditions of the printer unit. Further, because the same type of sensors are used, it is possible to prevent the costs thereof from increasing much, in comparison to a case where different types of sensors are used for the same purpose.

A thermal printer unit according to another aspect of the present invention comprises:

a thermal head assembly; and a platen roller, wherein:

the thermal head assembly comprises:

a frame having a platen roller receiving part receiving the platen roller;

a thermal head mounted on the frame;

a radiator plate, supported by the frame and having the thermal head fixed thereto, for radiating heat generated by the thermal head; and a spring member applying a head pressure to the thermal head, and wherein the radiator plate and the spring member are formed integrally.

In this configuration, as the radiator plate and spring member are formed integrally, it is possible to omit provision of any separate member in particular for the purpose of pressing the thermal head other than the radiator plate. Accordingly, it is possible to reduce the number of necessary components, and to reduce the costs of the printer unit.

Other objects and further features of the present invention will become more apparent from the following detailed description when read in conjunction with the accompanying drawings.

BRIEF DESCRIPTION OF THE DRAWINGS

FIG. 19 shows a relationship between operation condition of the thermal printer unit and outputs of comparators shown in FIG. 17 according to the present invention;

DETAILED DESCRIPTION OF THE PREFERRED EMBODIMENTS

Figure 1:
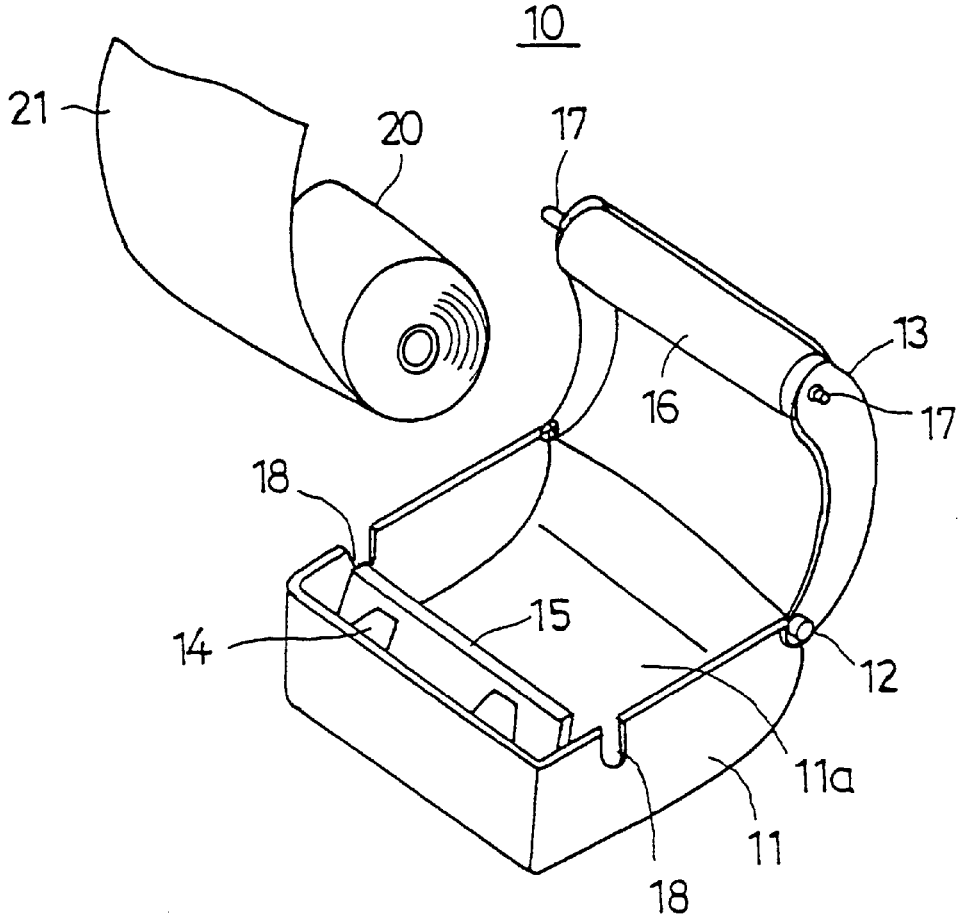
FIG. 1 PRIOR ART
FIG. 1 shows a line thermal printer in one example of the related art.
Figure 2:
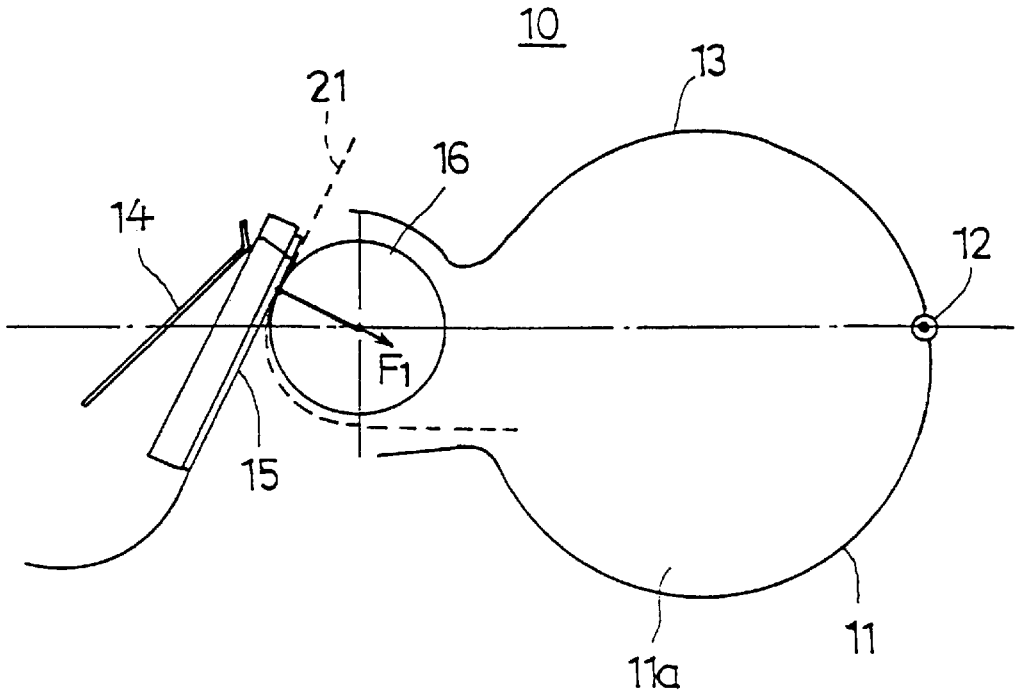
FIG. 2 PRIOR ART
FIG. 2 illustrates a configuration of the printer shown in FIG. 1.
Figure 3A:
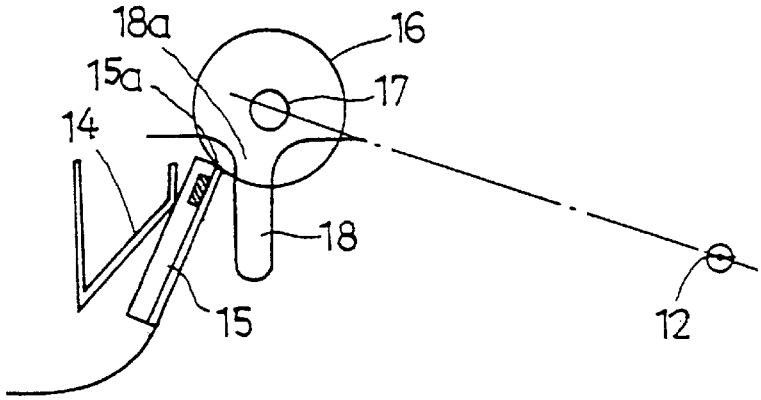
FIG. 3A PRIOR ART
FIGS. 3A, 3B and 3C illustrate operation of the printer shown in FIG. 2 when a cover is being closed.
Figure 3B:
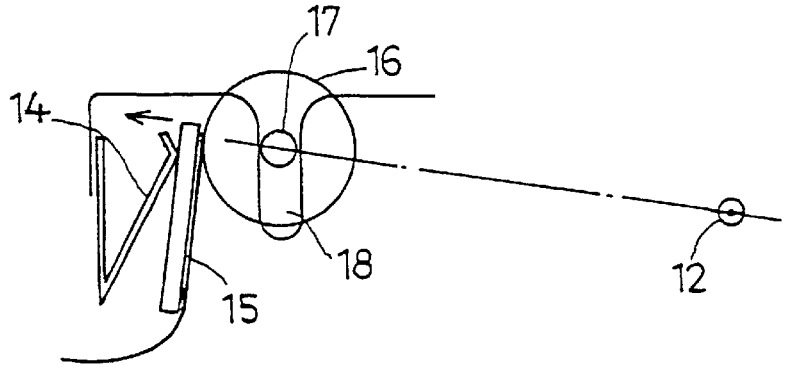
FIG. 3B PRIOR ART
Figure 3C:
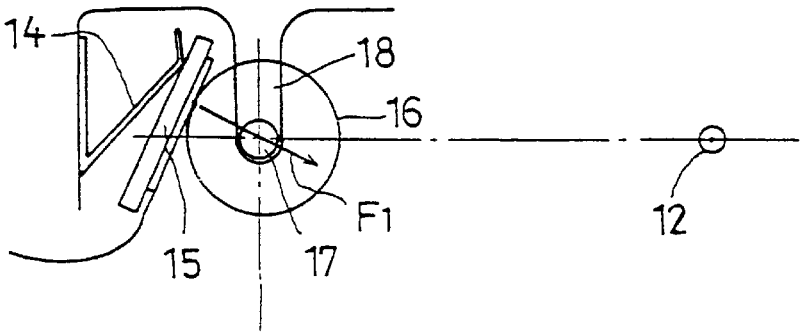
FIG. 3C PRIOR ART
Figure 4:
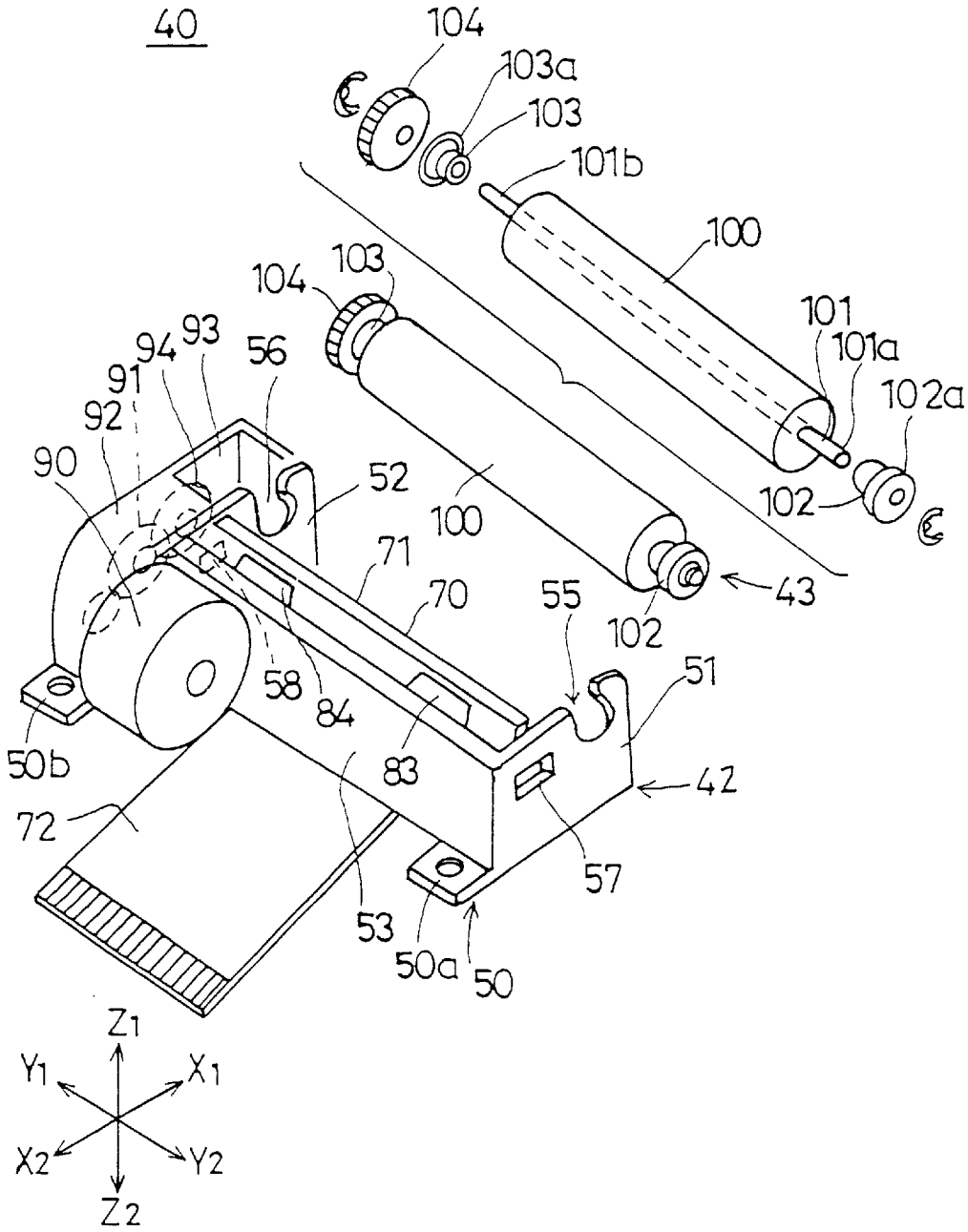
FIG. 4 shows a perspective view of a thermal printer unit in a first embodiment of the present invention.
Figure 5:
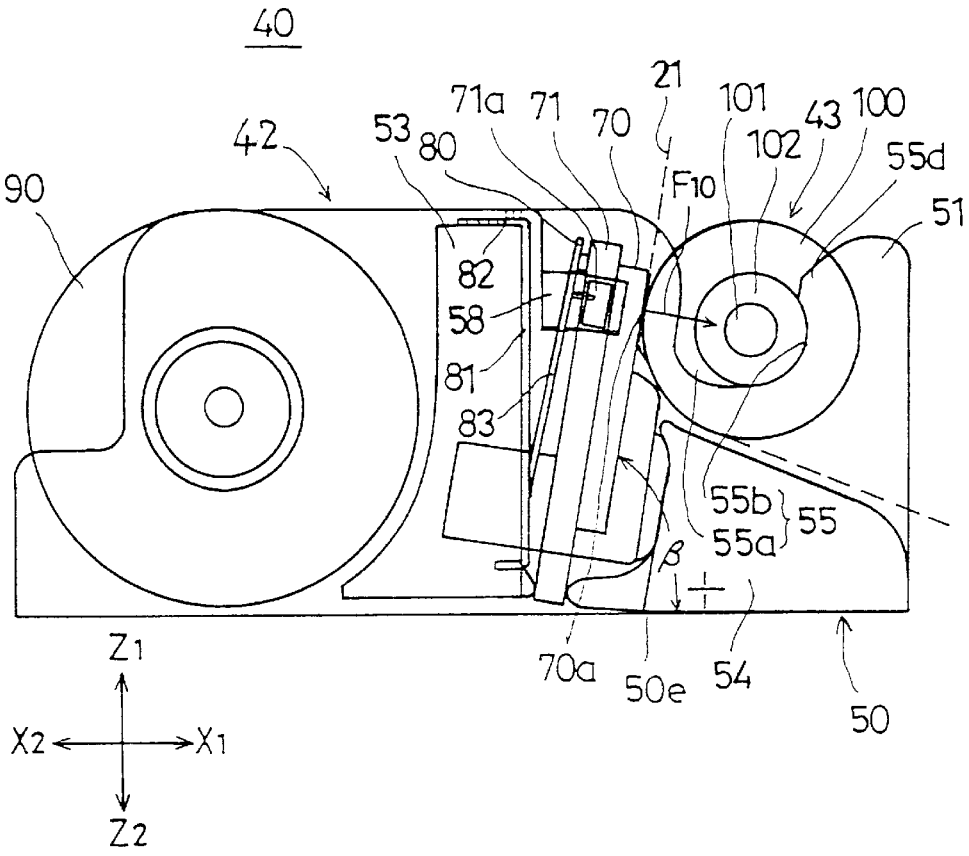
FIG. 5 shows a side-elevational sectional view of the thermal printer unit shown in FIG. 4.
Figure 8:
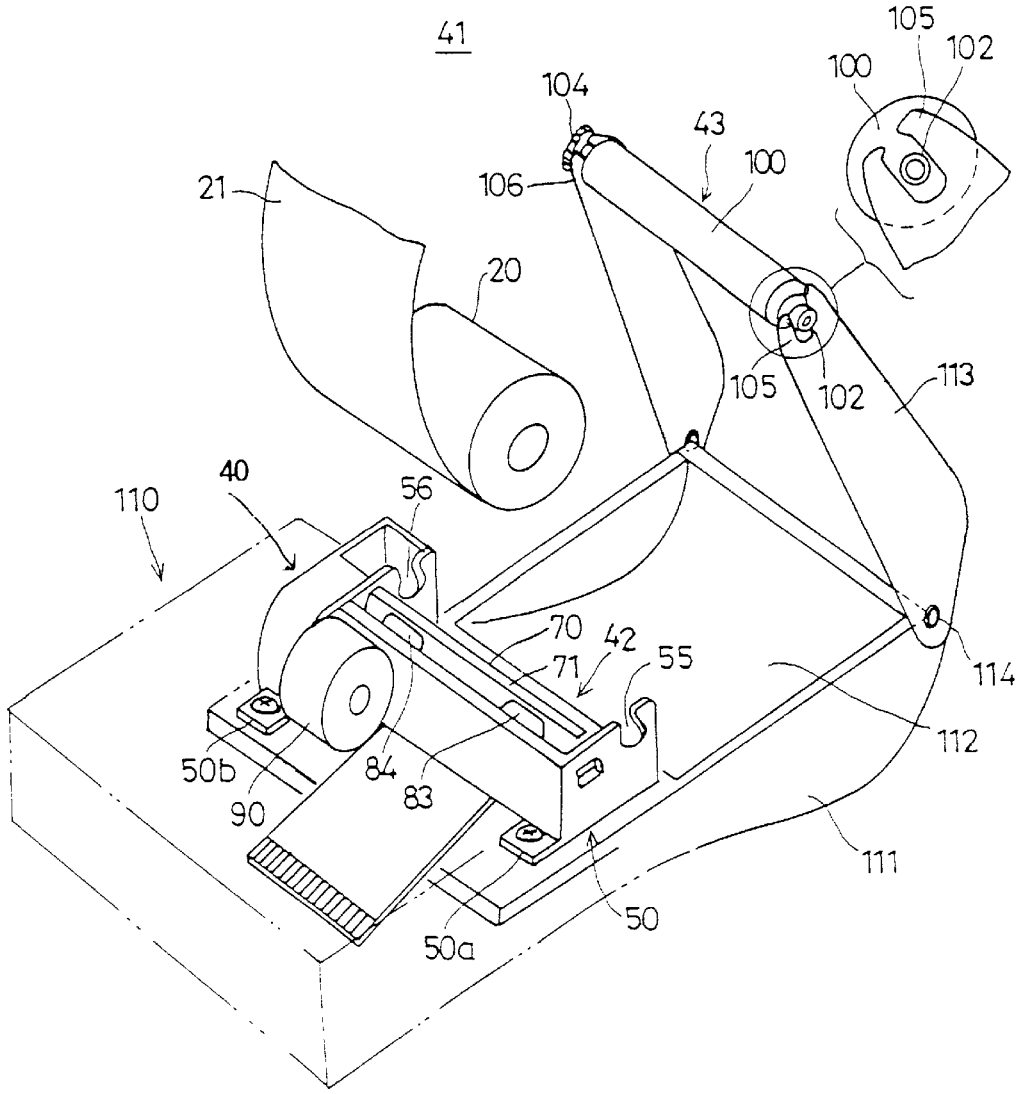
FIG. 8 shows a perspective view of a thermal printer in one embodiment of the present invention.

FIGS. 4 and 5 show a line thermal printer unit 40 in a first embodiment of the present invention. FIG. 8 shows a line thermal printer 41 including the above-mentioned line thermal printer unit 40.

The thermal printer unit 40 includes a thermal head assembly 42 and a platen roller assembly 43 combined therewith.

In the FIGS. 4 and 5, X1 and X2 denote longitudinal directions of the thermal printer unit 40, Y1 and Y2 denote lateral directions thereof, and Z1 and Z2 denote height (thickness) directions thereof. The X1 direction is a front direction of the thermal printer unit 40 while the X2 direction is a rear direction thereof.

The thermal head assembly 42 includes a frame 50, a thermal head 70 mounted in the frame 50, a head pressing leaf spring 80, and a paper feeding pulse motor 90.

The frame 50 is made by metal die-casting of aluminum or the like, has an outer shape of an approximately rectangular parallelepiped, has side plates 51 and 52 on both sides in the Y1 and Y2 directions, and has beams 53 and 54 extending along the Y1 and Y2 directions (see FIG. 5). Platen roller receiving parts 55 and 56 and thermal head stopper openings 57 and 58 are formed in the side plates 51 and 52, respectively.

Figure 6:
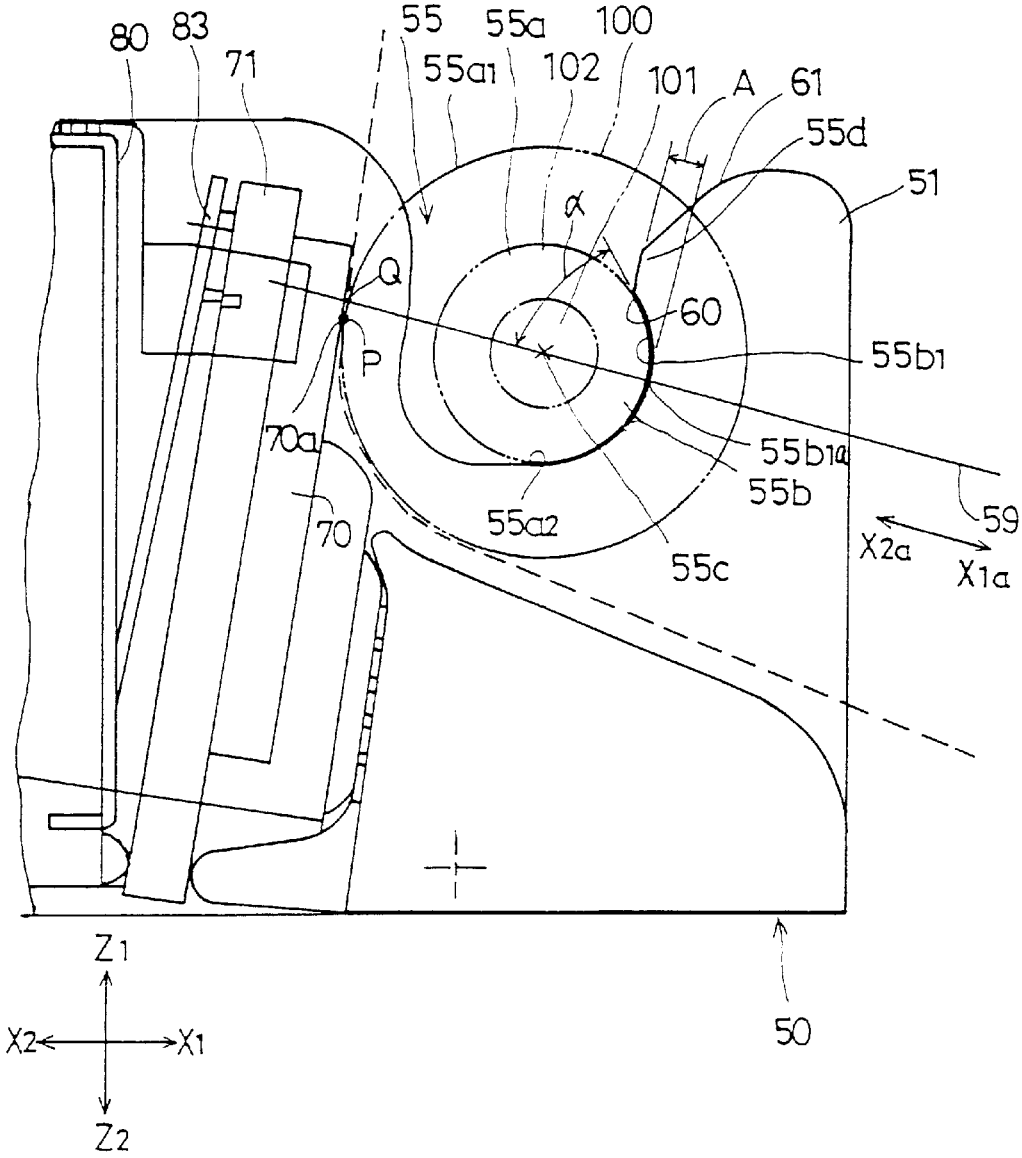
FIG. 6 illustrates a locked condition of a platen roller assembly of the printer unit shown in FIG. 4.

The platen roller receiving part 55 (56) is an approximately L-shaped cut-out, has a size corresponding to bearing members 102 and 103 which will be described later, and, as shown in FIG. 6 through magnification, includes a vertical groove part 55*a* extending in the Z2 direction, a horizontal groove part 55*b* extending from the bottom of the vertical groove part 55*a* in the X1 direction away from the thermal head 70, and a projection part 55*d*. The vertical groove part 55*a* has an opening 55*a*1 at the Z1-directional end thereof, and a bottom part 55*a*2 at the Z2-directional end thereof. The horizontal groove part 55*b* has an arc-shaped recess part 55*b*1 corresponding to the size of the bearing member 102 at the X1-directional end thereof. A point 55*c* shown in FIG. 6 represents the center of a circle including the outline of the arc-shaped recess part 55*b*1.

A straight line 59 shown in FIG. 6 passes through both a rotation shaft 114 of a cover 113 of the line thermal printer 41 shown in FIG. 8 and the above-mentioned center 55*c*. The directions X1*a* and X2*a* are directions along the above-mentioned straight line 59. This line 59 intersects the outline of the arc-shaped recess 55*b*1 at a point 55*b*1*a*.

In FIG. 6, the projection part 55*d* is formed relatively by the vertical groove part 55*a* and horizontal groove part 55*b*, is located above the horizontal groove part 55*b* and projects from the position of the recess part of the horizontal groove part 55*b* in the X2 direction toward the thermal head 70. As will be described later, the dimension and shape of the projection part 55*d* determine a strength of locking of a platen roller.

As shown in FIG. 6, the projection part 55*d* projects from the point 55*b*1*a* by a length A in the X2*a* direction. The projecting end of the projection part 55*d* has a surface 60. This surface 60 is inclined with respect to the straight line 59 by an angle $\alpha$. The above-mentioned length A is approximately on the order of 0.4 mm, and the angle $\alpha$ is approximately 60 degrees. The projection part 55*d* has, on the Z1 side thereof, an inclined surface 61 inclined in the direction toward the bottom part 55*a*2.

The platen roller receiving part 56 of the other side plate 52 has the same configuration as that of the above-mentioned platen roller receiving part 55 of the side plate 51.

As shown in FIG. 5, the ceramic thermal head 70 is fixed onto a radiator plate 71. The thermal head 70 has heating elements 70*a* aligned thereon along the Y1-Y2 directions, and, also, has an end of a flexible cable 72 connected thereto. The radiator plate 71 has positioning ear parts 71*a* at both ends thereof, as shown in FIG. 5. The head pressing leaf spring 80 includes a body part 81, a hook part 82 at the top thereof, and leaf spring parts 83 and 84 cut and raised from the body part 81, as shown in FIGS. 4 and 5.

Figure 9A:
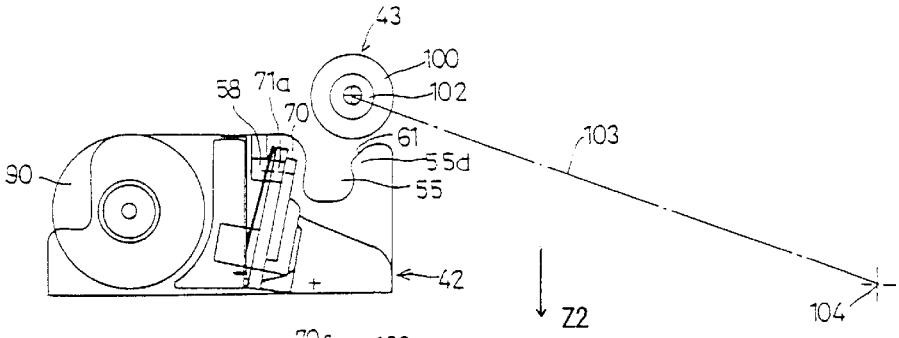
FIGS. 9A, 9B, 9C and 9D illustrate operation of a platen roller when it is reaching a locked position when a cover is closed, in the printer shown in FIG. 8.

The thermal head 70 is incorporated into the frame 50 as a result of the bottom end of the radiator plate 71 being supported by the frame 50, and the positioning eat parts 71*a* thereof being engaged with the thermal head stopper openings 57 and 58 of the side plates 51 and 52. The hook part 82 of the head pressing leaf spring 80 is fitted into the beam part 53, and the body part 81 thereof is mounted along the X1-directional side surface of the beam part 53, and the leaf spring parts 83 and 84 thereof press the radiator plate 71 in the X1 direction. As shown in FIG. 9A, the positioning ear parts 71*a* come into contact with the ends of the thermal head stopper openings 57 and 58, respectively, and, thereby, the thermal head 70 is positioned.

The paper feeding pulse motor 90 is mounted on an inner surface of the side plate 52, as shown in FIG. 4. Further, a box 92 in which a reduction gear mechanism 91 is incorporated is mounted on an outer surface of the side plate 52. An opening 93 is formed in the box 92 at a position facing the platen roller receiving part 56. A gear 94 at an end of the reduction gear mechanism 91 is located at a position adjacent to the opening 93.

As shown in FIG. 4, the platen roller assembly 43 includes the platen roller 100, a shaft 101 having a Y2-end projection part 101*a* and a Y1-end projection part 10*b*, a bearing member 102 mounted to the Y2-end projection part 101*a* and having a step part 102*a*, a bearing member 103 mounted to the Y1-end projection part 101*b* and having a step part 103*a*, and a gear 104 fixed to the Y1-end projection part 101*b*.

The bearing member 102 of this platen roller assembly 43 is fitted into the platen roller receiving part 55, the shaft-receiving part 103 thereof is fitted into the platen roller receiving part 56, and, thus, the platen roller assembly 43 is hanged between the side plates 51 and 52 of the frame 50, so that the platen roller assembly 43 is mounted in parallel to the thermal head 70. The gear 104 engages with the gear 94 of the reduction gear mechanism 91. The platen roller 100 pushes back the thermal head 70 slightly in the X1 direction, as shown in FIGS. 9C and 9D.

As shown in FIG. 5, a paper end 21 drawn out from a paper roll 20 lies between the thermal head 70 and platen roller 100, and, by the elastic force of the head pressing leaf spring 80, the heating elements 70*a* of the thermal head 70 are pressed onto the paper 21 with a force F10. The force F10 is a predetermined optimum head pressure. An inclination angle $\beta$ of the thermal head 70 with respect to the bottom plate 50*e* of the frame 50 is approximately 80 degrees, and, thus, is large.

When printing instructions are given to this thermal printer unit 40, the thermal head 70 is operated, the heating elements 70*a* generates heat according to the instructions so as to perform thermal printing on the paper 21, the pulse motor 90 is driven so as to rotate the platen roller 100 clockwise so that the paper 21 is fed accordingly, and, thus, the thus-printed paper 21 is fed out upward from the thermal printer unit 40, in FIG. 5.

The outer circumferential surface of the platen roller 100 is pressed by the heating elements 70*a* of the thermal head 70 with the force F10 via the paper 21 so that the bearing members 102 and 103 of the platen roller assembly 43 are pressed into the recess parts 55b1 of the horizontal groove parts 55b of the platen roller receiving parts 55 and 56, respectively. Thereby, the platen roller assembly 43 is locked into and thus prevented from being removed from the platen roller receiving parts 55 and 56 of the frame 50.

It may be assumed that the bearing members 102 and 103 are not provided and the projection parts 101a and 101b of the shaft 101 are directly received by the platen roller receiving parts 55 and 56. If so, the projection parts 101a and 101b of the shaft 101 rotate clockwise when the platen roller 100 rotates clockwise, so that the projection parts 101a and 101b roll on the edges of the platen roller receiving parts 55 and 56. As a result, the projection parts 101a and 101b will climb up the edges of the platen roller receiving parts 55 and 56 to go out from the platen roller receiving parts 55 and 56. However, actually, the bearing members 102 and 103 are provided as mentioned above, and the bearing members 102 and 103 are directly received by the platen roller receiving parts 55 and 56. Thereby, although the platen roller 100 rotates, (the outside shells of) the bearing members 102 and 103 do not rotate. Accordingly, no force occurs for causing the platen roller 100 to climb up to go out from the platen roller receiving parts 55 and 56. Thus, the platen roller assembly 43 is stably locked in the frame 50.

Further, the step parts 102a and 103a of the bearing parts 102 and 103 come into contact with the outer surfaces of the side plates 51 and 52. Thereby, the movement of the platen roller 100 along the Y1-Y2 directions is limited. As a result, the platen roller 100 is rotated stably without movement along the axis directions. Thereby, the printed paper 21 is stably fed, and printing on the paper 21 is performed satisfactorily.

How to change the strength of locking of the platen roller assembly 43 with the frame 50 will now be described.

As mentioned above, the dimension and shape of the projection part 55d of each of the platen roller receiving parts 55 and 56 determine the strength of the locking of the platen roller assembly 43 for preventing the platen roller assembly 43 from being removed from the platen roller receiving parts 55 and 56 accidentally.

Figure 7A:
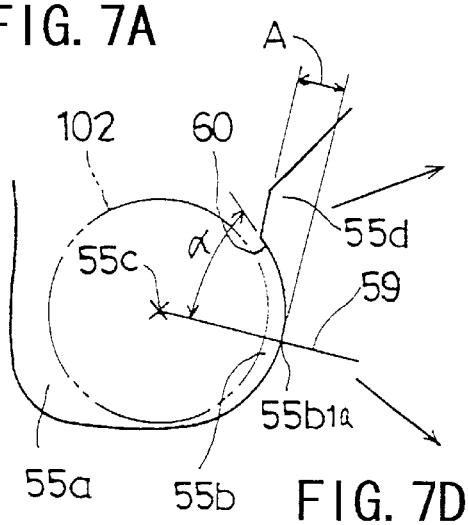
FIGS. 7A, 7B, 7C, 7D and 7E illustrate manners of adjustment of strength of locking of the platen roller assembly shown in FIG. 6.

FIG. 7A shows the form shown in FIG. 6.

Figure 7B:
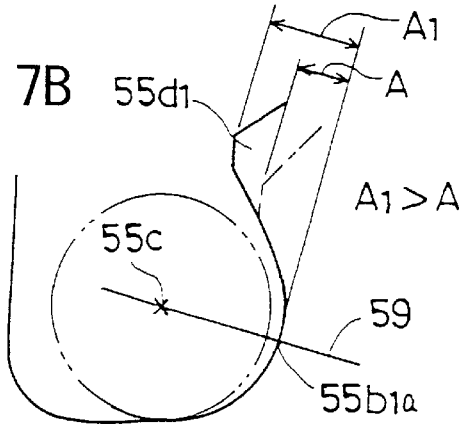

A first method of increasing the strength of the locking will now be described with reference FIG. 7B. The projection part 55d is configured as a projection part 55d1 shown in FIG. 7B. Thus, the projection amount of the projection part 55d1 is A1 larger than A of the original projection part 55d. Thereby, the platen roller assembly 43 is locked to the frame 50 more positively. However, the head pressure is not changed, and, is maintained in the optimum value.

Figure 7C:
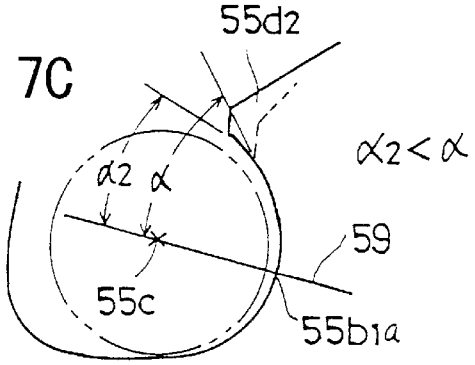

A second method of increasing the strength of the locking will now be described with reference FIG. 7C. The projection part 55d is configured as a projection part 55d2 shown in FIG. 7C. Thus, the projection part 55d2 has an angle $\alpha 2$ smaller than the angle $\alpha$ of the original projection part 55d. Thereby, the platen roller assembly 43 is locked to the frame 50 more positively. However, the head pressure is not changed, and, is maintained in the optimum value.

Figure 7D:
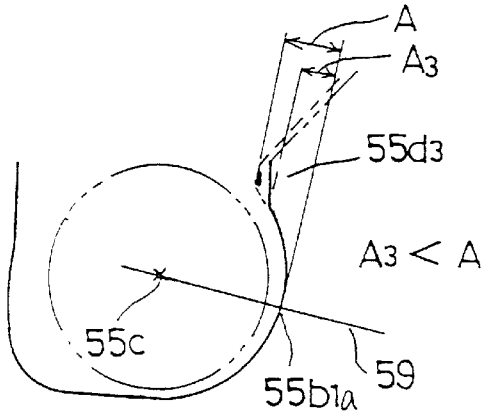

A first method of decreasing the strength of the locking will now be described with reference FIG. 7D. The projection part 55d is configured as a projection part 55d3 shown in FIG. 7D. Thus, the projection amount of the projection part 55d3 is A3 smaller than A of the original projection part 55d. Thereby, the platen roller assembly 43 is locked to the frame 50 less positively. However, the head pressure is not changed, and, is maintained in the optimum value.

Figure 7E:
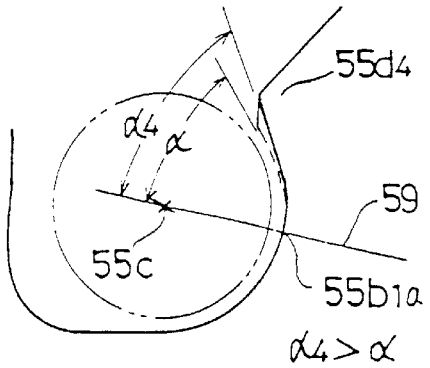

A second method of decreasing the strength of the locking will now be described with reference FIG. 7E. The projection part 55d is configured as a projection part 55d4 shown in FIG. 7E. Thus, the projection part 55d4 has an angle $\alpha 4$ larger than the angle $\alpha$ of the original projection part 55d. Thereby, the platen roller assembly 43 is locked to the frame 50 less positively. However, the head pressure is not changed, and, is maintained in the optimum value.

Thus, by changing the dimension and/or shape of the projection part 55d, it is possible to change the strength of the locking of the platen roller assembly 43 with the frame 50 without changing the head pressure.

The line thermal printer 41 in one embodiment of the present invention will now be described with reference to FIG. 8.

FIG. 8 shows the line thermal printer 41 which is a part of the portable terminal apparatus 110. The line thermal printer 41 is of a clam-shaped type, includes the line thermal printer unit 40 in the first embodiment of the present invention described above, and, further, includes a part for containing the paper roll 20, and a cover 113.

The above-mentioned thermal head assembly 42 is mounted to a base member 111 as a result of legs 50a and 50b of the frame 50 being screwed onto the base member 111. In the base member 111, a paper roll containing part 112, in which the paper roll 20 is held, is formed. The cover 113 is supported at the extending end of the base member 111 by the shaft 114. The above-mentioned platen roller assembly 43 is laterally hanged on the extending end of the cover 113 as a result of both ends thereof being fitted into fork-shaped arm parts 105 and 106 of the cover 113. The platen roller assembly 43 is in a condition such that it can move slightly but cannot be removed from the fork-shaped arm parts 105 and 106.

When the above-described line thermal printer 41 is used, the cover 113 is opened, the paper roll 20 having the paper end 21 thereof unwound therefrom is contained in the paper roll containing part 102, the unwound paper end 21 is drawn out so as to pass in front of the thermal head 70, and, then, the cover 113 is closed. Thereby, conditions shown in FIGS. 9A, 9B and 9C are passed through, and, then, a condition shown in FIG. 9D in which printing can be properly performed is reached.

Figure 9B:
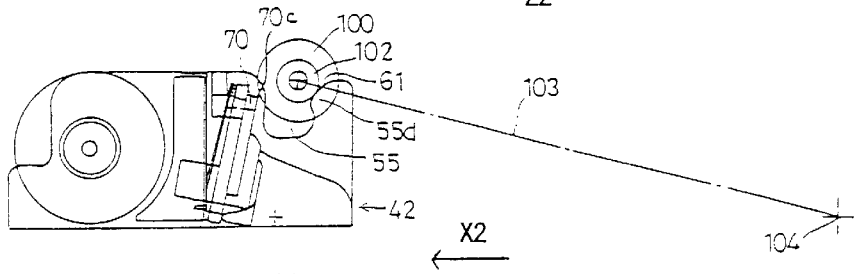
Figure 9C:
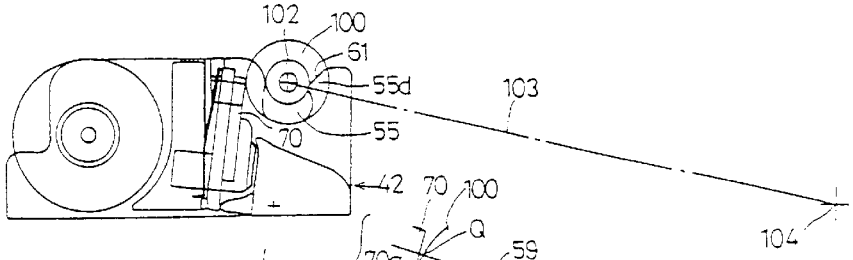
Figure 9D:
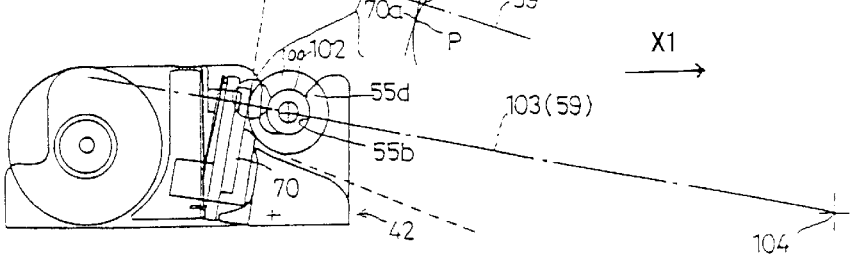

Specifically, at the last stage of closing the cover 113, the platen roller assembly 43 moves in the Z2 direction, as shown in FIGS. 9A and 9B, the bearing members 102 and 103 come into contact with the inclined surfaces 61 of the platen roller receiving parts 55 and 56, are guided by the surfaces 61 so as to move in the X2 direction, and then, start to enter the vertical groove parts 55a via the opening 55a1 of the platen roller receiving parts 55 and 56, respectively. During this process, the platen roller 100 comes into contact with the thermal head 70, and pushes it in the X2 direction, as shown in FIGS. 9B and 9C. Then, as shown in FIG. 9C, the bearing members 102 and 103 climb over the projection parts 55d, and enter the vertical groove parts 55a. Then, as a result of being pressed by the thermal head 70, the bearing members 102 and 103 are biased in the X1 direction, as shown in FIG. 9D, are fitted into the horizontal groove parts 55b, so as to enter below the projection parts 55d, and thus, the platen roller assembly 43 is locked in the platen roller receiving parts 55 and 56.

Exchange of the paper roll 20 is performed, when the necessity arises, after the cover 113 is opened as a result of the part of the cover 113 on the side of the platen roller 100 being pulled with a strong force.

In this line thermal printer 41, a wide space is formed between the thermal head 70 and platen roller 100 when the cover 113 is opened. Accordingly, it is easy to exchange the paper roll 20. Further, the cover 113 is locked through operation of closing the cover 113. The lock of the cover 113 is released when the cover 113 is pulled up. Accordingly, any other special locking operation or lock releasing operation is not needed. Accordingly, the printer is convenient in handling thereof.

Further, the position of the shaft 114 of the cover 113 is determined properly so that a point P (see FIGS. 6 and 9D) at which the heating elements 70*a* of the thermal head 70 come into contact with the platen roller 100 is shifted, in a direction (counterclockwise) reverse to a direction (clockwise) in which the platen roller 100 rotates so as to feed the paper 21, from a point Q at which the straight line 59 passing through the shaft 114 and the center 55*c* of the platen roller assembly 43 intersects the circumferential surface of the platen roller 100 on the side of the thermal head 70. Therefore, the inclination angle β of the thermal head 70 with respect to the bottom surface of the frame 50 is approximately 80 degrees, and, thus, is large, and a dimension the top end 70*c* of the thermal head 70 projects toward the platen roller 100 is short. Accordingly, a shock applied to the top corner 70*c* (see FIG. 9B) of the thermal head 70 by the platen roller 100 at the last stage of closing the cover 113 is effectively reduced, and, as a result, the platen roller 100 is not easily harmed thereby.

Figure 10A:
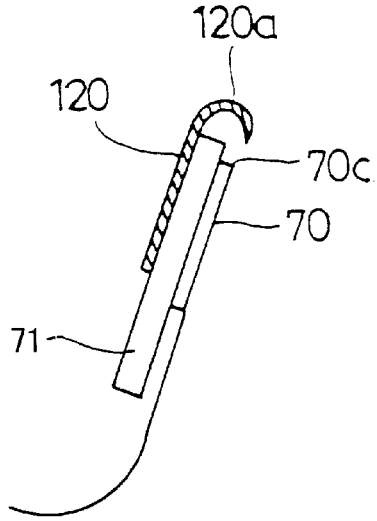
FIGS. 10A, 10B and 10C illustrate variant embodiments of a configuration in conjunction of a thermal head of the printer shown in FIG. 8.
Figure 10B:
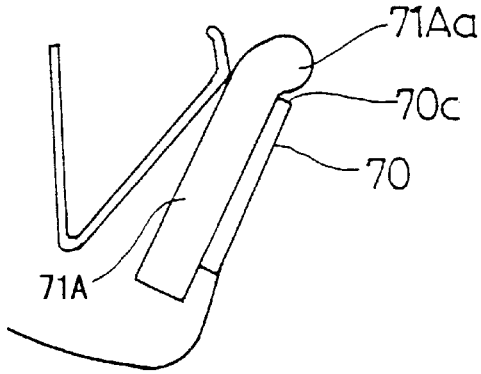
Figure 10C:
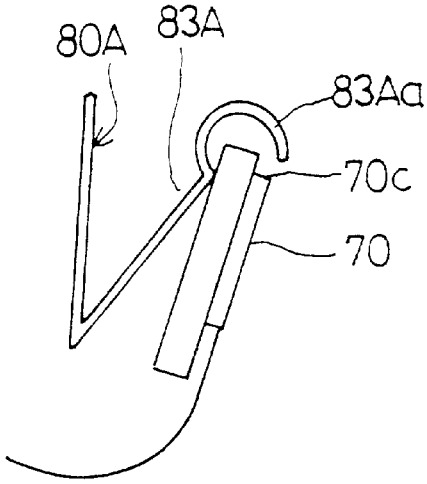
Figure 11:
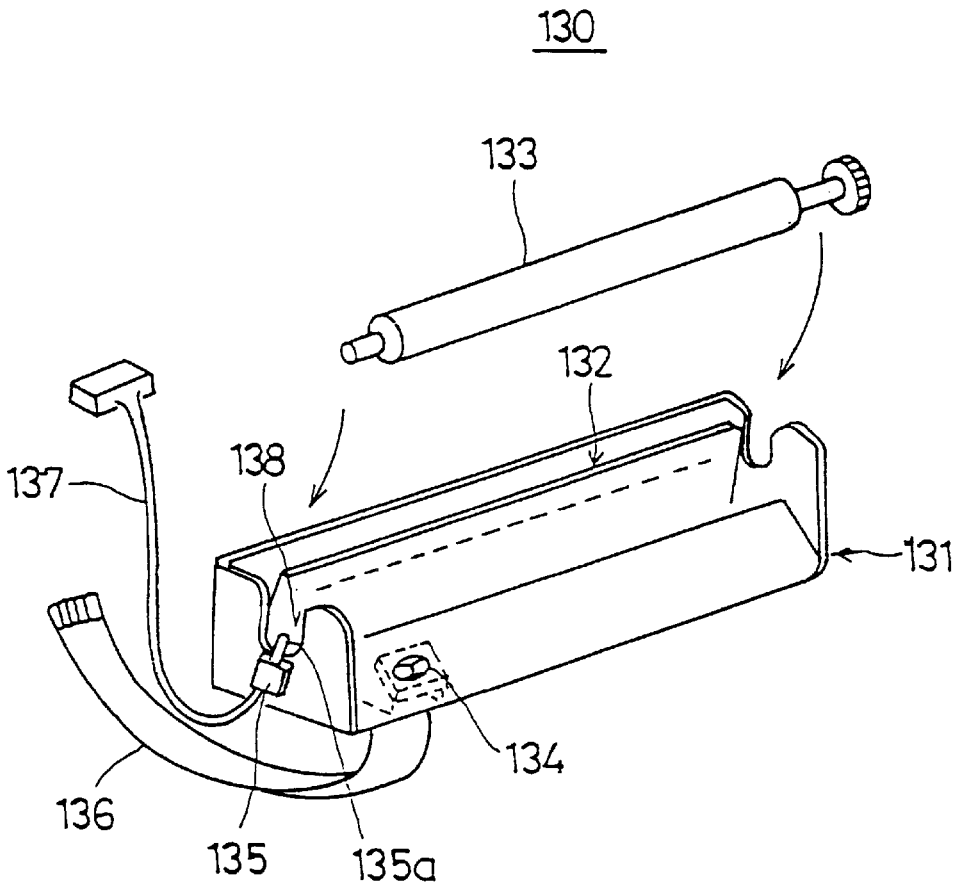
FIG. 11 PRIOR ART
FIG. 11 shows a thermal printer unit in another example of the related art.

Further, as shown in FIGS. 10A, 10B and 10C, the top end of the thermal head 70 may be covered. Thereby, the platen roller 100 can be positively prevented from being harmed by the top end 70*c* of the thermal head 70. In the example shown in FIG. 10A, a protection pad 120 is provided on the radiator plate 71. Thereby, a curved part 120*a* of a protection pad 120 covers the top end 70*c* of the thermal head 70. In the example shown in FIG. 10B, a radiator plate 71A having an extension part 71A*a* curving is provided at the top end thereof. In this case, the curved extension part 71A*a* covers the top end 70*c* of the thermal head 70. In the example shown in FIG. 10C, a head pressing leaf spring 83A having an extension part 83A*a* curving is provided at the top end thereof. In this case, the curved extension part 83A*a* covers the top end 70*c* of the thermal head 70. In any configuration, the platen roller 100 comes into contact with the curved part 120*a,* extension part 71A*a* or 83A*a* so that the platen roller 100 is prevented from directly coming into contact with the top corner 70*c* of the thermal head 70. Accordingly, the platen roller 100 is prevented from being harmed.

Figure 12:
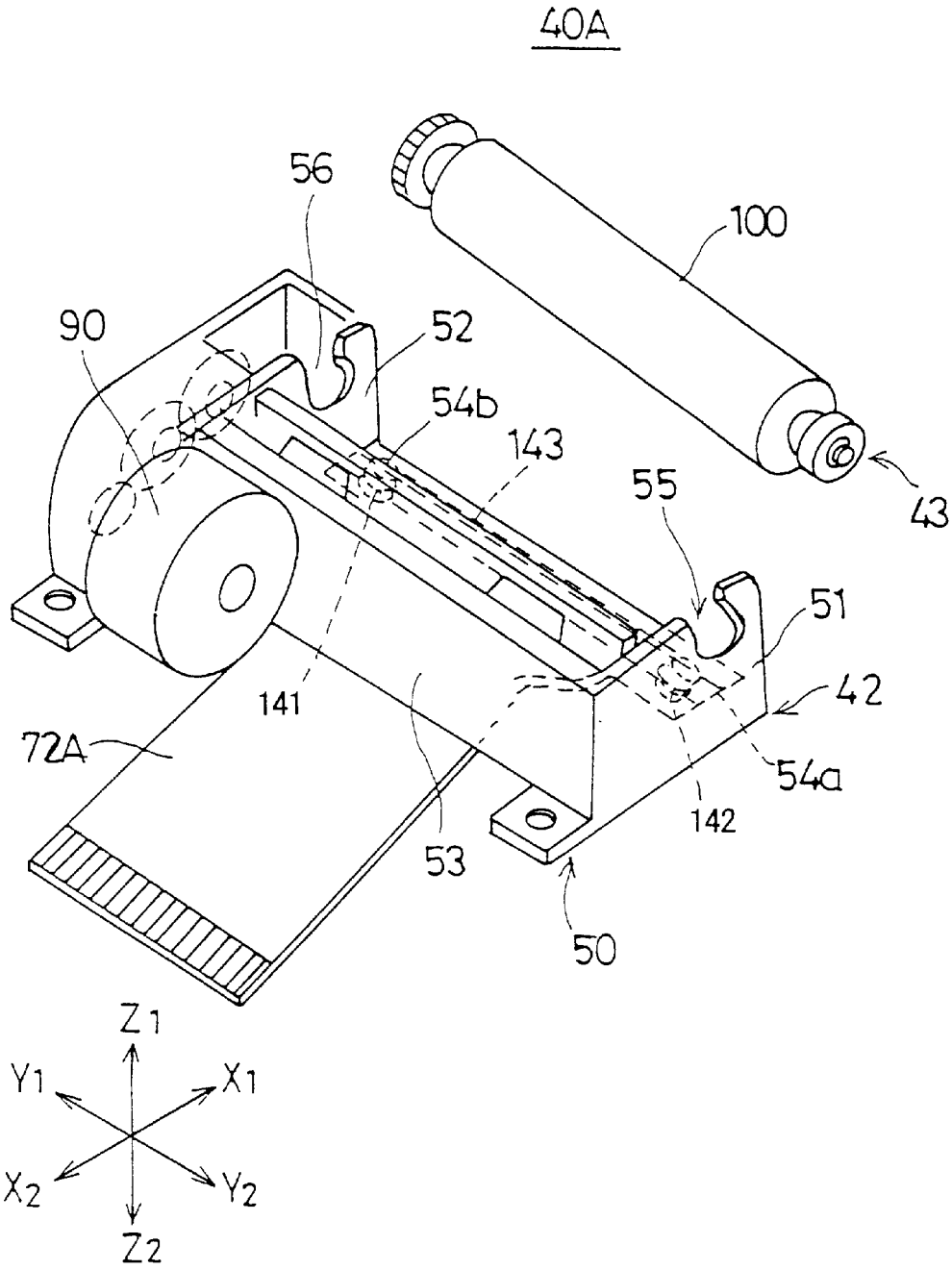
FIG. 12 shows a perspective view of a thermal printer unit in a second embodiment of the present invention.
Figure 13:
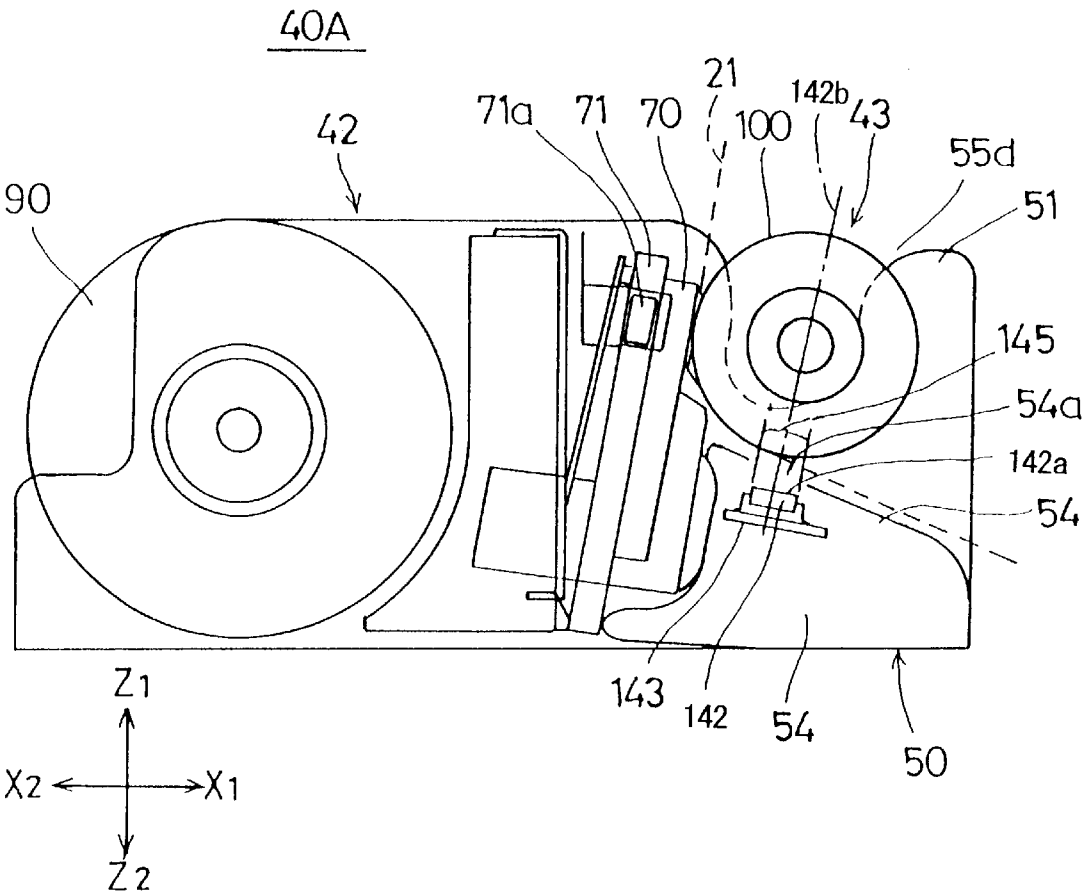
FIG. 13 shows a side-elevational sectional view of the thermal printer unit shown in FIG. 12.
Figure 14:
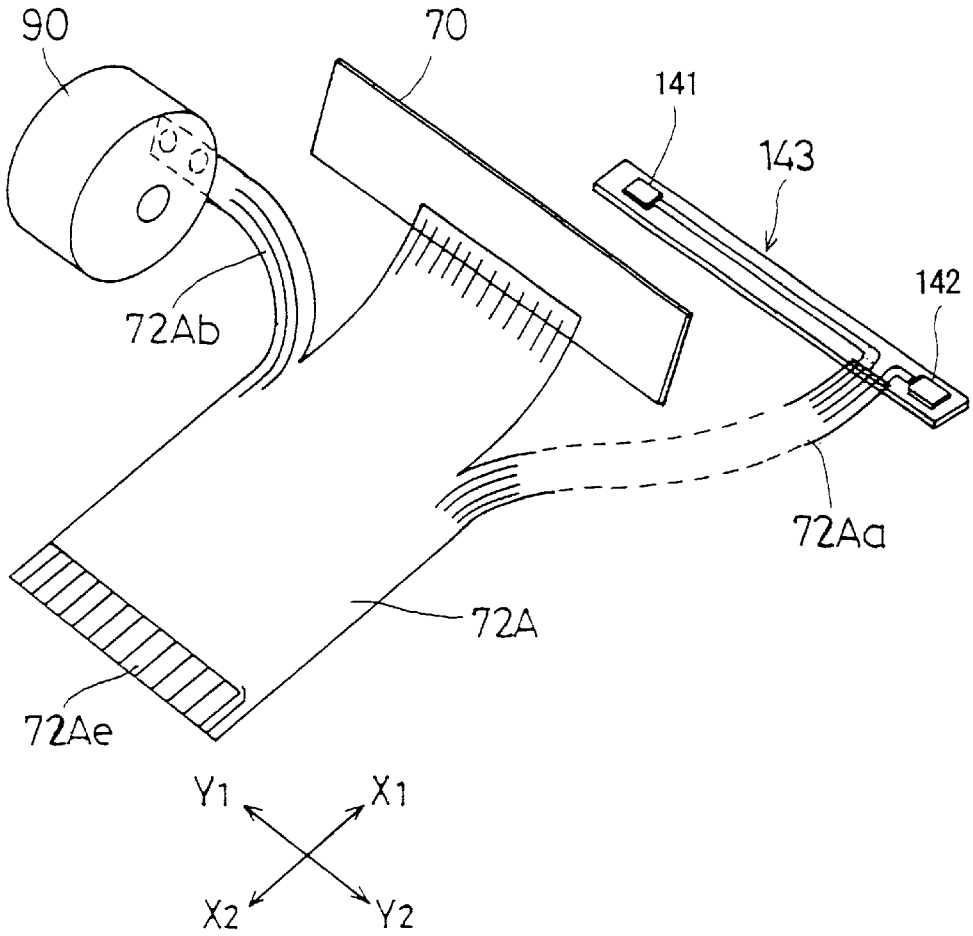
FIG. 14 illustrates connection of a flexible cable with a printed substrate, a thermal head and a pulse motor in the printer unit shown in FIG. 12.

With reference to FIGS. 12, 13 and 14, a line thermal printer unit 40A in a second embodiment of the present invention will now be described.

The line thermal printer unit 40A in the second embodiment has a configuration such that, two photosensors are additionally provided to the line thermal printer unit 40 shown in FIGS. 4 through 7E. In FIGS. 12 through 14, the same reference numerals are given to components the same as those shown in FIGS. 4 and 5, and the description thereof is omitted.

As shown in FIGS. 12 through 14, the two photosensors, i.e., first photosensor 141 and second photosensor 142 are mounted on the top surface of a slender printed substrate 143 near both ends thereof. Each of these photosensors 141 and 142 has a configuration in which a light emitting part and a light receiving part receiving light emitted by the light emitting part and reflected by something, side by side. The printed substrate 143 is fixed on a bottom side of the beam 54 of the frame 50. Further, the beam 54 has openings 54*a* and 54*b* formed therein at positions corresponding to the two photosensors 141 and 142. The first photosensor 141 is located in the Y1 direction while the second photosensor 142 is located in the Y2 direction. Accordingly, the two photosensors 141 and 142 and printed substrate 143 are provided in a space below the beam 54, and is incorporated into the frame 50 without projecting in the Y1 and Y2 directions therefrom. Further, no mechanical switch is provided therein.

As shown in FIG. 13, with respect to the platen roller assembly 43, the first photosensor 142 is disposed below the platen roller 100 in the proximity of the Y2-directinal end thereof, and, also, thereby, a normal 142*b* of a sensor surface 142*a* of the photosensor 142 passes through the center axis of the platen roller assembly 43. In FIG. 13, the photosensor 142 can monitor a range 145. With respect to the paper 21 partially unwound from the paper roll 20, the first photosensor 142 is disposed so as to face the paper 21 in the proximity of the Y2-directinal end thereof. Similarly, the second photosensor 141 is disposed below the platen roller 100 in the proximity of the Y1-directinal end thereof, and, also, the second photosensor 141 is disposed so as to face the paper 21 in the proximity of the Y1-directinal end thereof.

As shown in FIG. 14, the flexible cable 72A has a branch flexible cable part 72A*a* in the X1 direction, branched in the Y2 direction. A terminal part which is an extending end of the branch flexible cable part 72A*a* is soldered onto a terminal part on the printed substrate 143. On the other hand, a main part of the flexible cable 72A is soldered onto a terminal part of the thermal head 70. Further, another branch flexible cable part 72A*b* branched in the Y1 direction is soldered onto a terminal part of the pulse motor 90. Accordingly, in the line thermal printer unit 40A, the thermal head 70, pulse motor 90, first and second photosensors 141, 142 and an external circuit are electrically connected together by the single flexible cable 72A.

Operation of the line thermal printer unit 40A in connection with outputs of the two photosensors 141 and 142 will now be described.

① When printing is performed in a condition, as shown in FIG. 13 (normal condition), the photosensors 141 and 142 face the paper 21. As the paper 21 has a white color and thus has a high reflectance, the light receiving parts of the photosensors 141 and 142 receive a high intensity of reflected light. Accordingly, each of the photosensors 141 and 142 outputs a voltage of approximately 5 volts.

Figure 15:
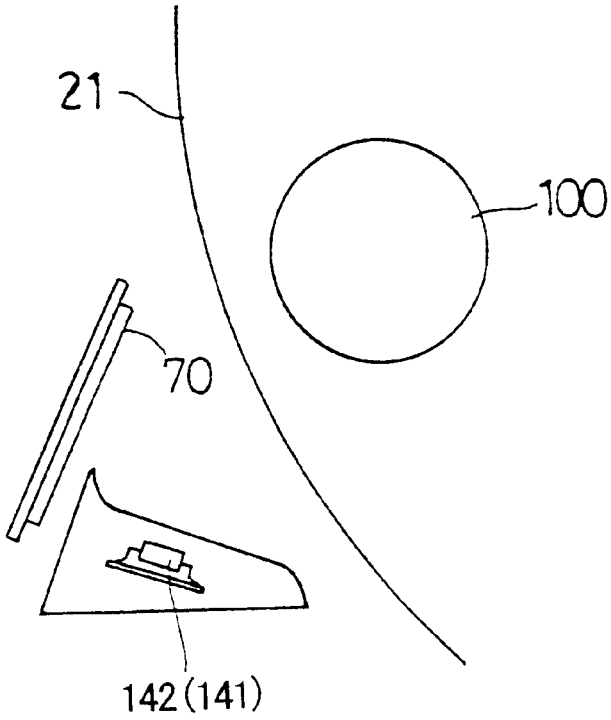
FIG. 15 illustrates a platen roller assembly released condition.

② When the platen roller assembly 43 is removed from the proper position by accident during printing operation, as shown in FIG. 15 (platen roll assembly released condition), the paper 21 moves upward so as to be far away from the photosensors 141 and 142. Accordingly, merely little light emitted by the light emitting parts and reflected by the paper 21 returns to the light receiving parts of the photosensors 141 and 142. As a result, the photosensors 141 and 142 output approximately 0 volts. It is noted that the paper 21 has a property such that it does not tear easily, and, during printing operation, the paper 21 is forcibly curved along the circumferential surface of the platen roller 100 as shown in FIG. 13 due to a force applied to the paper 21 by the platen roller 100. This is a reason why the paper 21 moves upward when the platen roller assembly 43 is removed from the proper position as mentioned above.

Figure 16:
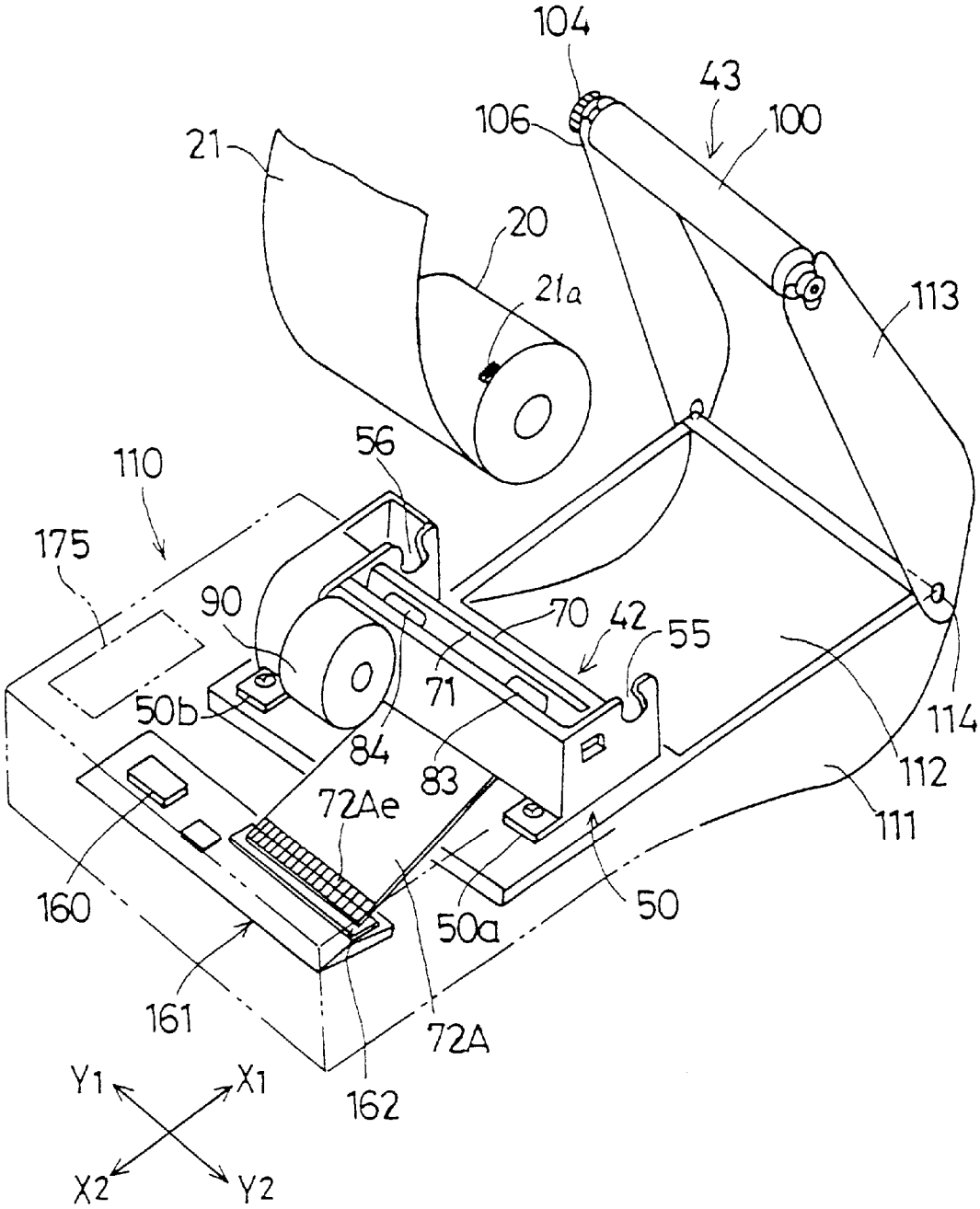
FIG. 16 shows a perspective view of a portable terminal apparatus including the thermal printer unit shown in FIG. 12 according to the present invention.

③ When the paper 21 of the paper roll 20 has been approximately run out during printing operation (paper near end condition), as a black painted part 21*a* is formed near the ending edge of the paper 21 of the paper roll 20 at the Y2-directiaon end thereof, as shown in FIG. 16, the black panted part 21*a* reaches a position immediately above the second photosensor 142. As the black painted part 21*a* has a low reflectance, the output voltage of the second photosensor 142 is approximately 0 volts. On the other hand, the output voltage of the photosensor 141 is maintained as approximately 5 volts.

④ When the paper 21 of the paper roll 20 has been run out during printing operation (paper end condition), both first and second photosensors 141 and 142 directly face the platen roller 100. As the platen roller 100 is made of rubber and thus has a color of gray, it has a low reflectance in surface thereof. As a result, the output voltage of each of the photosensors 141 and 142 is approximately 3 volts.

As shown in FIG. 16, the above-mentioned line thermal printer unit 40A is used in a condition in which it is incorporated into the portable terminal apparatus 110A, wherein the above-mentioned first and second photosensors 141 and 142 detect condition of operation of the line thermal printer unit 40A.

How the condition of operation of the line thermal printer unit 40A is thus detected in the portable terminal apparatus 110A will now be described.

The terminal part 72A*e* at the X2-directinal end of the above-mentioned flexible cable 72A is connected to a connector 162 of a circuit substrate module 161 on which an LSI package 160 and so forth are mounted, included in the portable terminal apparatus 110A, as shown in FIG. 16.

Figure 17:
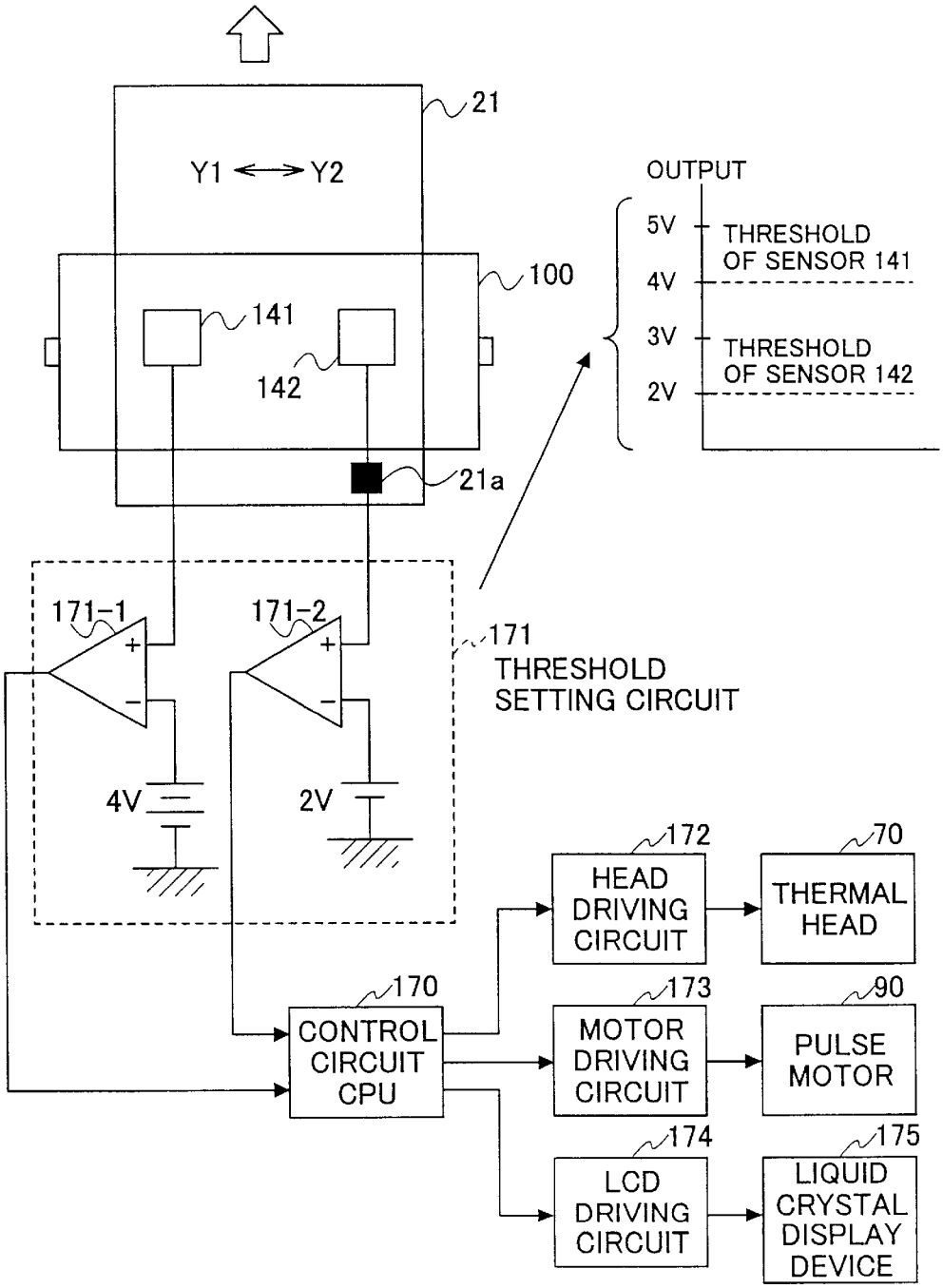
FIG. 17 shows a block diagram in connection with first and second photosensors in the portable terminal apparatus shown in FIG. 16 according to the present invention.

FIG. 17 shows a block diagram of a part of the portable terminal apparatus 110A in conjunction with the two photosensors 141 and 142. To a control circuit 170, a threshold setting circuit 171, a thermal head driving circuit 172, a pulse motor driving circuit 173 and a liquid crystal display device driving part 174 are connected. A liquid crystal display device 175 is provided on a top surface of the portable terminal apparatus 110A, as shown in FIG. 16.

The threshold setting circuit 171 includes a comparator 171-1 having the non-inverted terminal thereof connected with the first photosensor 141, and a comparator 171-2 having the non-inverted terminal thereof connected with the second photosensor 142. The voltage of 4 volts is applied to the inverted terminal of the comparator 171-1 while the voltage of 2 volts is applied to the inverted terminal of the comparator 171-2. Accordingly, the comparator 171-1 has a threshold of 4 volts while the compactor 171-2 has a threshold of 2 volts. The comparator 171-1 outputs an L signal when the output voltage of the first photosensor 141 is lower than 4 volts, and outputs an H signal when the output voltage of the first photosensor 141 is equal to or higher than 4 volts. The comparator 171-2 outputs an L signal when the output voltage of the second photosensor 142 is lower than 2 volts, and outputs an H signal when the output voltage of the second photosensor 142 is equal to or higher than 2 volts.

Figure 18:
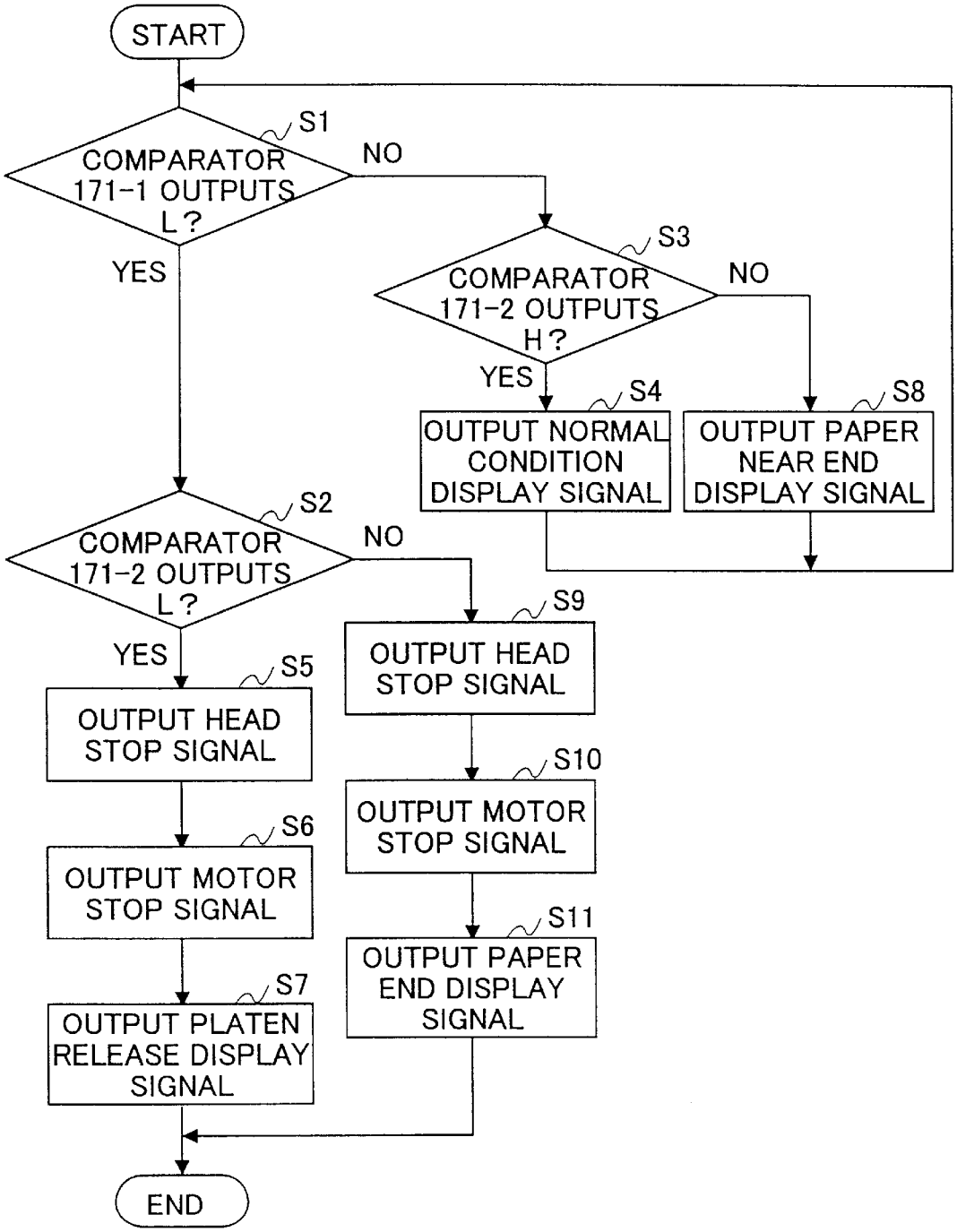
FIG. 18 shows a flow chart of operation of a control part shown in FIG. 17.

The above-mentioned control circuit 170 operates as shown in FIG. 18.

In a step S1, it is determined whether or not the comparator 171-1 outputs the L signal. When the comparator 171-1 outputs the L signal, it is determined in a step S2 whether or not the comparator 171-2 also outputs the L signal. When it is determined in the step S1 that the comparator 171-1 does not output the L signal, it is determined in a step S3 whether or not the comparator 171-2 outputs the H signal.

When it is determined in the step S3 that the comparator 171-2 outputs the H signal, a signal for displaying that it is the normal condition is output to the liquid crystal display device driving circuit 174 in a step S4.

When a determination result of the step S2 is YES, a thermal head stopping signal is output to the thermal head driving circuit 172 in a step S5, a pulse motor stopping signal is output to the pulse motor driving circuit 173 in a step S6, and a signal for displaying that it is the platen roller assembly released condition is output to the liquid crystal display device driving circuit 174 in a step S7.

When a determination result of the step S3 is NO, a signal for displaying that it is the paper near end condition is output to the liquid crystal display device driving circuit 174 in a step S8.

When a determination result of the step S2 is NO, the thermal head stopping signal is output to the thermal head driving circuit 172 in a step S9, the pulse motor stopping signal is output to the pulse motor driving circuit 173 in a step S10 and a signal for displaying that it is the paper end condition is output to the liquid crystal display device driving circuit 174 in a step S11.

FIG. 19 shows relationship between the outputs of the comparators 171-1 and 171-2 and the condition of the line thermal printer unit 40A.

Thereby, when the comparator 171-1 outputs the H signal and also the comparator 171-2 outputs the H signal, the liquid crystal display device 175 displays that it is the normal condition.

When the comparator 171-1 outputs the L signal and comparator 171-2 also outputs the L signal, the driving of the thermal head 70 is stopped, the driving of the pulse motor 90 is stopped, and the display device 175 displays that it is the platen roller assembly released condition.

When the comparator 171-2 outputs the L signal in the condition in which both compactors 171-1 and 171-2 output the H signals, the driving of the thermal head 70 is stopped, the driving of the pulse motor 90 is stopped, and the display device 175 displays that it is the paper near end condition.

When the comparator 171-1 outputs the L signal in the condition in which both compactors 171-1 and 171-2 output the H signals, the driving of the thermal head 70 is stopped, the driving of the pulse motor 90 is stopped, and the display device 175 displays that it is the paper end condition.

It is also possible to detect a condition in which the paper 21 partially unwound from the paper roll 20 is drawn so as to lie obliquely. In such a case, when the photosensor 141 thereby faces the platen roller 100 directly, the comparator 171-1 outputs the L signal. Accordingly, the printing operation is stopped as in the case of the paper end condition. Thus, it is possible to previously prevent the paper 21 from being wrinkled, or torn in due to the oblique movement of the paper.

Figure 20:
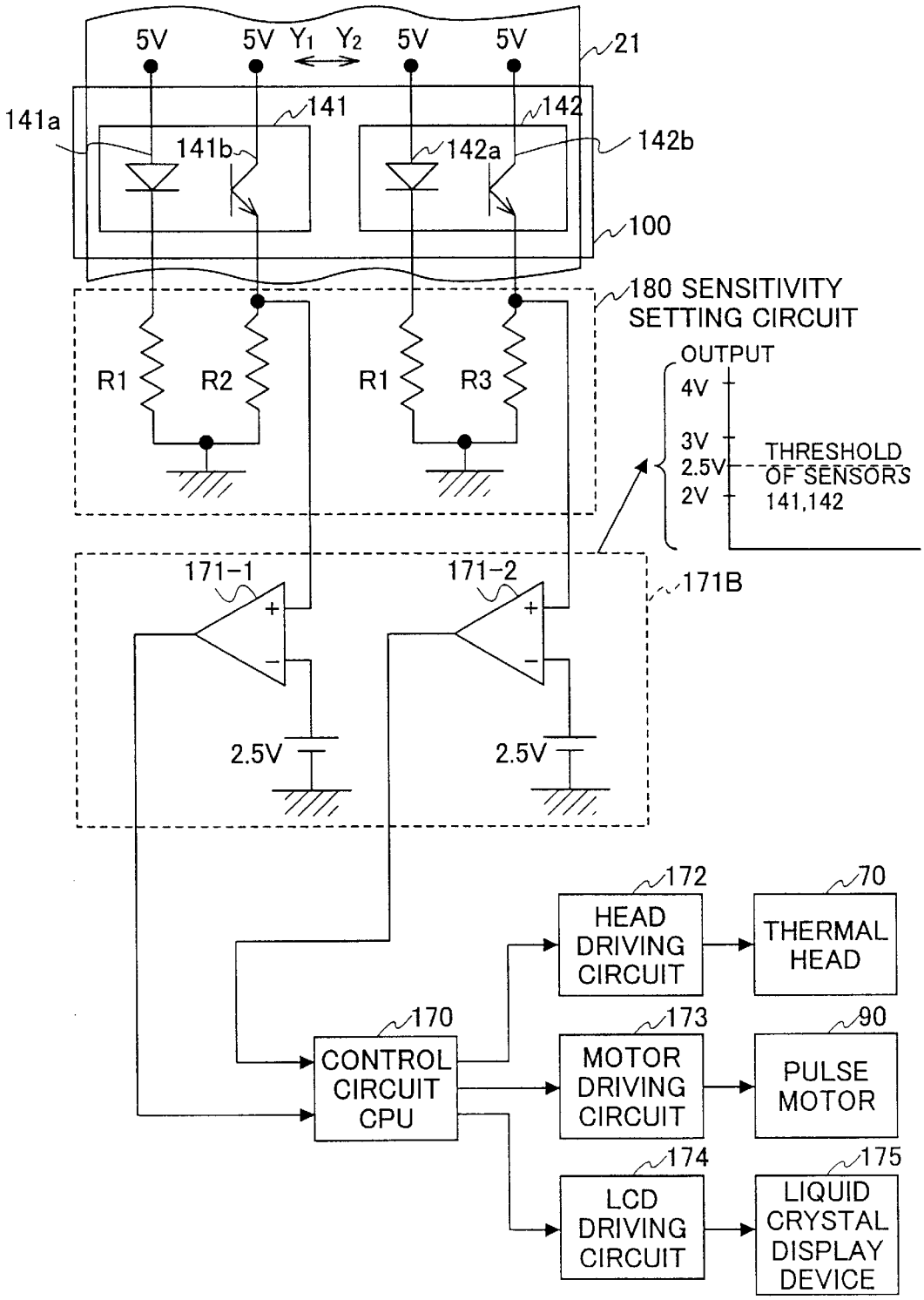
FIG. 20 shows a block diagram in a variant embodiment in connection with first and second photosensors in the portable terminal apparatus shown in FIG. 16 according to the present invention.

FIG. 20 shows a block diagram of a variant embodiment of the part of the portable terminal apparatus 110A in conjunction with the two photosensors 141 and 142.

In this variant embodiment, both comparators 171-1 and 171-2 have the same threshold (2.5 volts) in a threshold setting circuit 171B. Then, a circuit 180 for setting the sensitivities of the first and second photosensors 141 and 142 is additionally provided.

This circuit 180 includes resistors R1 having a same resistance r1 which are connected to the light emitting parts 141*a* and 142*a* of the photosensors 141 and 142, respectively. Further, a resistor R2 having a resistance r2 is connected to the light receiving part 141*b* of the first photosensor 141 while a resistor R3 having a resistance r3 larger than the resistance r2 (r3>r2) is connected to the light receiving part 142*b* of the second photosensor 142. Thereby, the output voltages taken between the light receiving parts 141*b* and 142*b* and the resistors R2 and R3, respectively, are such as those obtained as if the second photosensor 142 has a sensitivity higher than that of the first photosensor 141. Accordingly, when both photosensors 141 and 142 face the gray-colored platen roller 100, the output voltage of the first photosensor 141 is lower than the threshold (2.5 volts) while the output voltage of the second photosensor 142 is higher than the threshold (2.5 volts). As a result, the relationship between the outputs of the comparators 171-1 and 171-2 and the condition of the line thermal printer unit 40A is the same as that shown in FIG. 19.

Figure 21A:
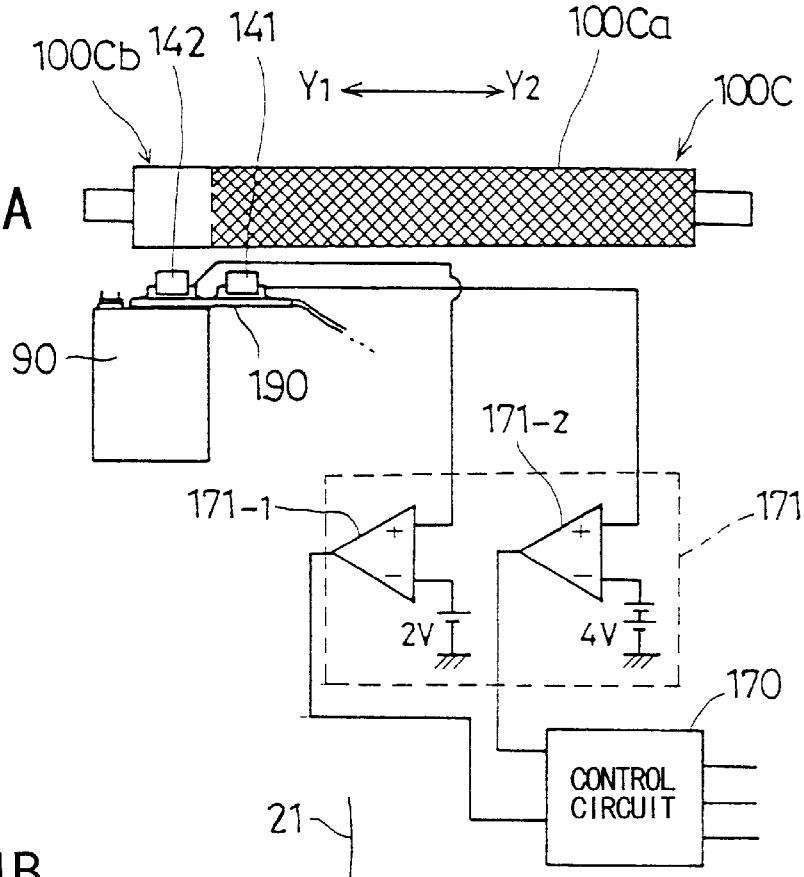
FIGS. 21A and 21B show a first variant embodiment of disposition of the photosensors according to the present invention.
Figure 21B:
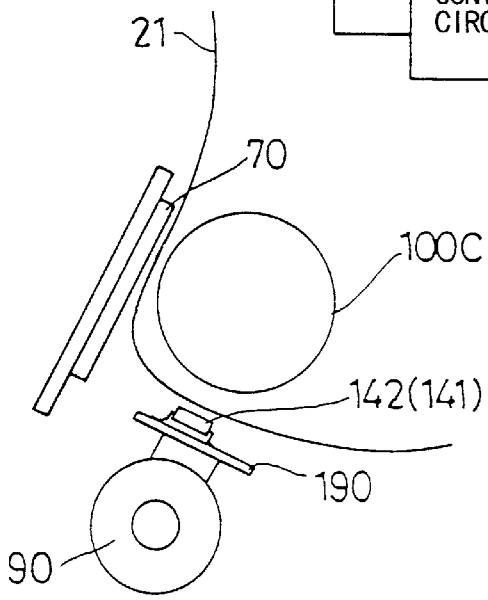

FIGS. 21A and 21B show a first variant embodiment of the displacement of the photosensors 141 and 142 of the above-mentioned line thermal printer unit 40A. In this variant embodiment, a platen roller 100C has a color of white at an Y2-directinal portion thereof, as shown in FIG. 21A, and, as shown in the figure, the photosensors 141 and 142 are disposed to face a portion near the Y1-directional end of the platen roller 100C. The photosensors 141 and 142 are mounted on a terminal circuit substrate 190 of the pulse motor 90. Thus, it is not necessary to provide any other member especially for mounting the photosensors 141 and 142.

This platen roller 100C is manufactured through two-color mold of rubber, and includes a gray-colored portion 100C*a* and a white-colored portion 100C*b*. The first photosensor 141 faces the gray-colored portion 100C*a* while the second photosensor 142 faces the white-colored portion 100C*b*. Accordingly, when the paper 21 has been completely run out (paper end condition), the second photosensor 142 maintains to output 5 volts.

In this case, the threshold setting circuit 171 shown in FIG. 17 is used in which 4 volts is set as the threshold for the comparator 171-1 while 2 volts is set as the threshold for the comparator 171-2. However, the first photosensor 141 is connected to the comparator 171-2 while the second photosensor 142 is connected to the comparator 171-1, as shown in FIG. 21A. Further, in this case, the black-painted part 21*a* shown in FIG. 16 is provided at the Y1-directional end instead of the Y2-directinal end. Accordingly, the relationship between the outputs of the comparators 171-1 and 171-2 and the condition of the line thermal printer unit 40A is the same as that shown in FIG. 19.

As mentioned above, the photosensors 141 and 142 are mounted on the terminal circuit substrate 190 of the pulse motor 90 and no additional member is needed for mounting the photosensors 141 and 142. Accordingly, it is possible to reduce the number of necessary components. Also, it is possible to achieve mounting of the sensors 141 and 142 within a small space. Furthermore, the flexible cable such as that shown in FIG. 14 having a complex shape is not needed. Specifically, the branch part 72A*a* is not needed. Accordingly, it is possible to simplify the shape of the flexible cable, and to achieve simpler wiring.

Figure 22A:
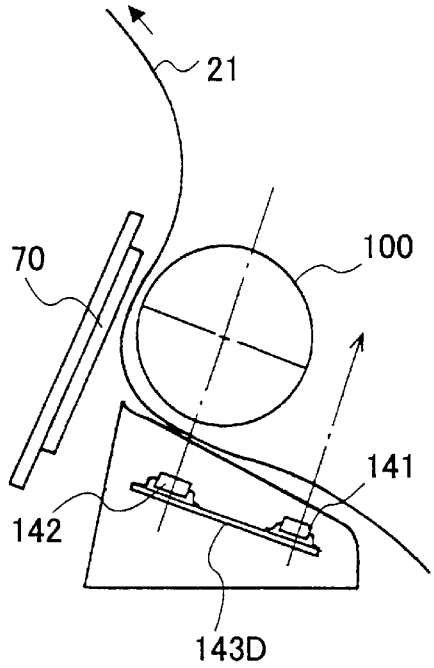
FIGS. 22A and 22B show a second variant embodiment of the disposition of the photosensors according to the present invention.
Figure 22B:
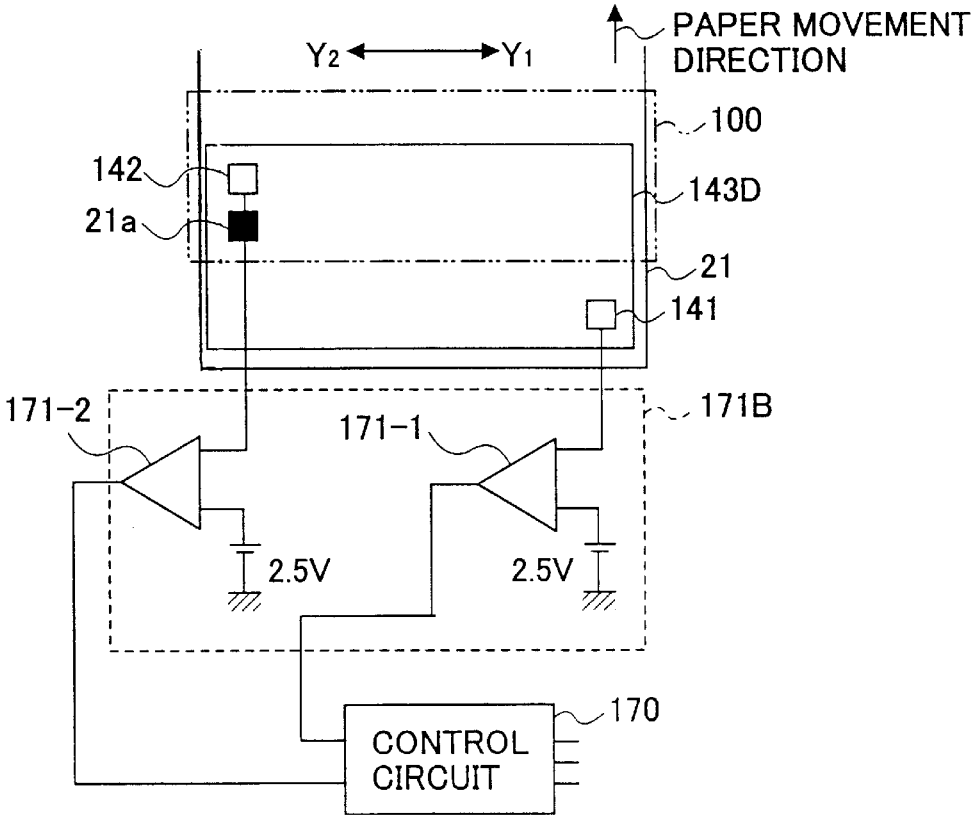

FIGS. 22A and 22B show a second variant embodiment of the disposition of the photosensors 141 and 142. In this embodiment, the two photosensors 141 and 142 are mounted on a circuit substrate 143D at diagonal positions, as shown in FIG. 22B. The second photosensor 142 is located in the Y2 direction and faces the platen roller 100 while the first photosensor 141 is located in the Y1 direction and is shifted from a position of facing the platen roller 100.

In this case, as shown in FIG. 22B, in the paper near end condition, the second photosensor 142 faces the above-mentioned black-painted part 21*a* while the first photosensor 141 faces a normal white portion of the paper 21. Accordingly, the second photosensor 142 outputs approximately 0 volts while the first photosensor 141 outputs approximately 5 volts. Then, in the paper end condition, in which the paper 21 has moved upward in FIG. 22B so that the second photosensor 141 faces a normal white part of the paper 21 while the paper end edge has passed by the first photosensor 141 and thus nothing exists in front thereof, the second photosensor 142 outputs approximately 5 volts (and then approximately 3 volts after the end edge of the paper 21 passes by the second photosensor 142 also) while the first photosensor 141 outputs approximately 0 volts.

In this second variant embodiment, each of the comparators 171-1 and 171-2 has the same threshold (2.5 volts) in a threshold setting circuit 171B, as shown in FIG. 22B. Further, the two photosensors 141 and 142 have the same sensitivity. In these conditions, the relationship between the outputs of the comparators 171-1 and 171-2 and the condition of the line thermal printer unit 40A is the same as that shown in FIG. 19.

Figure 23A:
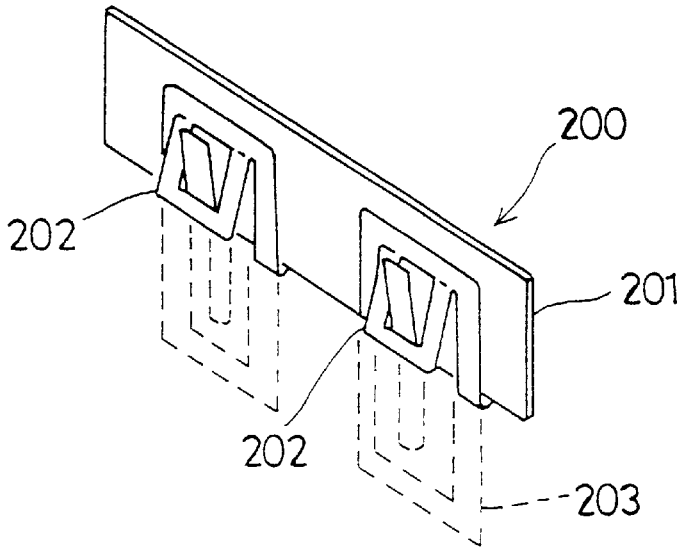
FIGS. 23A and 23B show a first variant embodiment of a radiator plate of a thermal head according to the present invention.
Figure 23B:
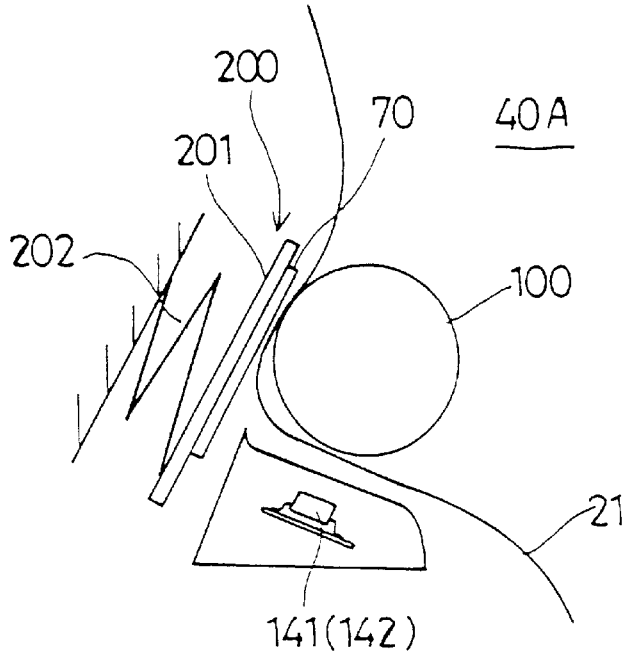

FIGS. 23A and 23B show a first variant embodiment of the above-mentioned radiator plate 71. A radiator plate 200 in the first variant embodiment is made of metal, and, has head pressing leaf springs 202 integrated with a radiator plate body 201. The head pressing leaf springs 202 are formed as a result of portions 203 extending from the radiator plate body 201 being bent through press work. This radiator plate 200 has both a function as a radiator and a function as a head pressing leaf spring. This radiator plate 200 is incorporated into the line thermal printer unit 40A as shown in FIG. 23B. In this configuration, no other separate members are needed for providing the function of head pressing leaf springs. Accordingly, it is possible to reduce the number of necessary components.

Figure 24:
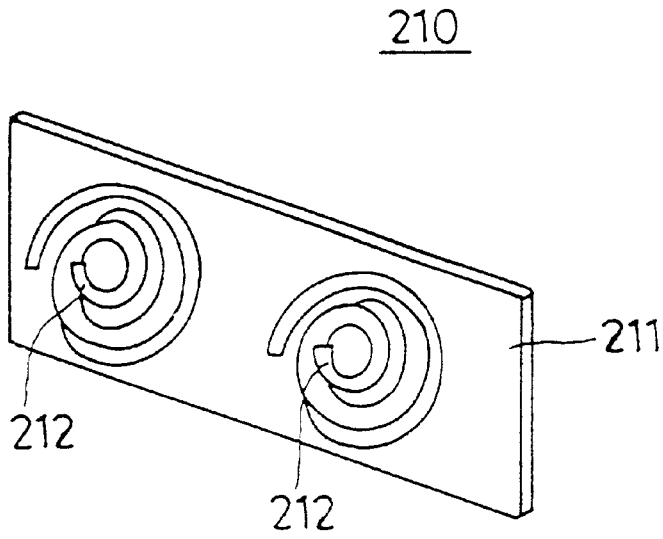
FIG. 24 shows a second variant embodiment of the radiator plate of the thermal head according to the present invention.

FIG. 24 shows a second variant embodiment of the radiator plate 71. A radiator plate 210 in the second variant embodiment has conic-coil-spring-shaped head pressing leaf springs 212 formed as a result of spiral strips formed in a radiator plate body 211 being pressed out.

Further, the present invention is not limited to the above-described embodiments, and variations and modifications may be made without departing from the scope of the present invention.

The present application is based on Japanese priority applications Nos. 2000-240477 and 2000-306725, filed on Aug. 8, 2000 and Oct. 5, 2000, respectively, the entire contents of which are hereby incorporated by reference.

What is claimed is:

1. A thermal printer unit comprising:

a thermal head assembly; and a platen roller, wherein:

said thermal head assembly comprises:

a frame having platen roller receiving parts receiving both ends of said platen roller, respectively;

a thermal head mounted on said frame; and a spring member mounted on said frame and applying a head pressure to said thermal head, wherein each platen roller receiving part comprises:

a vertical groove part having an opening at the top thereof;

a horizontal groove part extending from the bottom of said vertical groove part in a direction such as to be away from said thermal head; and a projection part formed relatively by said vertical groove part and horizontal groove part, located above said horizontal groove part, and projecting from a depth part of said horizontal groove part toward said thermal head, and wherein both ends of said platen roller are inserted into the horizontal groove parts of said platen receiving parts, respectively, and, also, are pressed by said spring member over said thermal head into the depth parts thereof, respectively; and wherein said thermal head is obliquely provided so that said thermal head is pressed onto said platen roller by said spring member, thereby preventing said platen roller from being moved upward unless an external force of predetermined magnitude is applied to said platen roller to move said thermal head against a resilient force of said spring member.

2. The thermal printer unit as claimed in claim 1, wherein:

said platen roller comprises bearing members at both ends thereof; and said bearing member rotatably support said both ends of said platen roller in said horizontal groove parts, respectively.

3. The thermal printer unit as claimed in claim 1, wherein a member is provided for covering a top end of said thermal head so as to prevent said platen roller from directly coming into contact with the top end of said thermal head.

4. The thermal printer unit as claimed in claim 1, wherein:

said thermal head assembly further comprises photosensors provided on the rear side of said platen roller receiving part so as to face said platen roller; and said photosensors are used for detecting, through combination of outputs thereof, any of a condition in which printing operation can be properly performed by said printer unit, a condition in which paper for the printing is nearly run out, a condition in which the paper for the printing is run out, and a condition in which said platen roller is removed from said platen roller receiving part.

5. A thermal printer comprising:

a body comprising a paper roll containing part for holding a paper roll a thermal head assembly mounted on said body, and comprising: a frame having platen roller receiving parts receiving both ends of a platen roller, respectively; a thermal head mounted on said frame; and a spring member mounted on said frame and applying a head pressure to said thermal head; and a cover rotatably supported by said body, supporting said platen roller, and covering an opening of said paper roll containing part, wherein, in a condition in which said opening of said paper roll containing part is covered by said cover, said platen roller is pressed onto said thermal head, and said platen roller is fitted into said platen roller receiving parts so that said cover is maintained in the condition in which said opening is covered by said cover, and wherein each platen roller receiving part comprises:

a vertical groove part having an opening at the top thereof;

a horizontal groove part extending from the bottom of said vertical groove part in a direction such as to be away from said thermal head; and a projection part formed relatively by said vertical groove part and horizontal groove part, located above said horizontal groove part, and projecting from a depth part of said horizontal groove part toward said thermal head, and wherein, in the condition in which said cover covers said opening of said paper roll containing part, both ends of said platen roller are inserted into the horizontal groove parts of said platen roller receiving parts, respectively, and, also, are pressed by said spring member through said thermal head into the depth parts thereof, respectively; and wherein said thermal head is obliquely provided so that said thermal head is pressed onto said platen roller by said spring member, thereby preventing said platen roller from being moved upward unless an external force of predetermined magnitude is applied to said platen roller to move said thermal head against a resilient force of said spring member.

6. The thermal printer as claimed in claim 5 wherein:

said platen roller comprises bearing members at both ends thereof; and said bearing members rotatably support said both ends of said platen roller in said horizontal groove parts, respectively.

7. The thermal printer as claimed in claim 5 wherein a member is provided for covering a top end of said thermal head so as to prevent said platen roller from directly coming into contact with the top end of said thermal head.

8. The thermal printer as claimed in claim 5 wherein:

a first position located on an outline of said platen roller, at which said thermal head comes into contact with said platen roller loaded into said horizontal groove parts, is different from a second position on the outline of said platen roller on the side of said thermal head at which the outline of said platen roller is intersected by a straight line passing through both the rotational axis of said cover and the center of said platen roller loaded into said horizontal groove part, said first position being located in a direction reverse to a direction in which said platen roller rotates during feeding of the paper.

9. The thermal printer as claimed in claim 5 wherein:

said thermal head assembly further comprises photosensors provided on the rear side of said platen roller receiving parts so as to face said platen roller; and said photosensors are used for detecting, through combination of outputs thereof, any of a condition in which printing operation of said printer can be properly performed, a condition in which paper for the printing is nearly run out, a condition in which paper for the printing is run out, and a condition in which said platen roller is removed from said platen roller receiving parts.

10. A thermal printer unit comprising a thermal head assembly; and a platen roller, wherein:

said thermal head assembly comprises:

a frame having a platen roller receiving part receiving said platen roller;

a thermal head mounted on said frame; and a spring member mounted on said frame and applying a head pressure to said thermal head, wherein:

said thermal head assembly further comprises photosensors provided on the rear side of said platen roller receiving part so as to face said platen roller; and said photosensors are used for detecting, through combination of outputs thereof, any of a condition in which printing operation can be properly performed by said printer unit, a condition in which paper for the printing is nearly run out, a condition in which the paper for the printing is run out, and a condition in which said platen roller is removed from said platen roller receiving part.

11. A thermal printer comprising:

a body comprising a paper roll containing part for holding a paper roll;

a thermal head assembly mounted on said body, and comprising: a frame having a platen roller receiving part receiving a platen roller; a thermal head mounted on said frame; and a spring member mounted on said frame and applying a head pressure to said thermal head; and a cover rotatably supported by said body, supporting said platen roller, and covering an opening of said paper roll containing part, wherein, in a condition in which said opening of said paper roll containing part is covered by said cover, said platen roller is pressed onto said thermal head, and said platen roller is fitted into said platen roller receiving part so that said cover is maintained in the condition in which said opening is covered by said cover, and wherein:

said thermal head assembly further comprises photosensors provided on the rear side of said platen roller receiving part so as to face said platen roller; and said photosensors are used for detecting, through combination of outputs thereof, any of a condition in which printing operation of said printer can be properly performed, a condition in which paper for the printing is nearly run out, a condition in which the paper for the printing is run out, and a condition in which said platen roller is removed from said platen roller receiving part.

12. A thermal head assembly mounted on a body of a thermal printer including a platen roller and a cover rotatably supported by the body and rotatable into a closed condition, the thermal head assembly comprising:

a thermal head;

a frame having the thermal head provided obliquely thereon, and having platen roller receiving parts to receive both ends of the platen roller, the platen roller being fitted into the platen roller receiving parts to maintain a position of the cover when the cover is covering the opening, each platen roller receiving part having a vertical groove part having an opening at the top, a horizontal groove part, having a depth part, and extending from the bottom of the vertical groove part in a direction away from the thermal head, and into which both ends of the platen roller are pressed when the cover covers the opening, and a projection part, formed relatively by the vertical groove part and the horizontal groove part, located above the horizontal groove part, and projecting from the depth part toward the thermal head; and a spring member, mounted on the frame, applying a head pressure to the thermal head to press the thermal head onto the platen roller and to press the ends of the platen roller, respectively, into the depth parts of the horizontal groove parts when the cover is covering the opening, to prevent the platen roller from moving upward unless an external force of predetermined magnitude is applied to the platen roller to move the thermal head against the head pressure applied by the spring member.

* * * * *

UNITED STATES PATENT AND TRADEMARK OFFICE

CERTIFICATE OF CORRECTION

PATENT NO. : 6,682,239 B2
DATED : January 27, 2004
INVENTOR(S) : Yukihiro Mori et al.

It is certified that error appears in the above-identified patent and that said Letters Patent is hereby corrected as shown below:

Column 17,
Line 19, change “member” to -- members --.
Line 40, after “roll” insert -- ; --.

Column 18,
Line 25, after “5” insert -- , --.

Signed and Sealed this

Eighteenth Day of May, 2004

JON W. DUDAS
*Acting Director of the United States Patent and Trademark Office*